United States Patent [19]

Fujimura et al.

[11] Patent Number: 5,016,596

[45] Date of Patent: May 21, 1991

[54] AIR-FUEL RATIO CONTROL METHOD FOR INTERNAL COMBUSTION ENGINES

[75] Inventors: Akira Fujimura; Sachito Fujimoto; Fumio Hosoda, all of Wako, Japan

[73] Assignee: Honda Giken Kogyo K.K., Tokyo, Japan

[21] Appl. No.: 516,100

[22] Filed: Apr. 27, 1990

[30] Foreign Application Priority Data

May 1, 1989 [JP] Japan ..... 1-112888
Sep. 11, 1989 [JP] Japan ..... 1-236126
Sep. 11, 1989 [JP] Japan ..... 1-236127

[51] Int. Cl.[5] ..... F02D 41/14
[52] U.S. Cl. ..... 123/489
[58] Field of Search ..... 123/440, 489, 492

[56] References Cited

U.S. PATENT DOCUMENTS 4,488,529 12/1984 Nishida et al. ..... 123/489
4,561,403 12/1985 Oyama et al. ..... 123/489
4,617,900 10/1986 Kobayashi et al. ..... 123/489
4,694,805 9/1987 Yatabe et al. ..... 123/489
4,751,906 6/1988 Yatabe et al. ..... 123/489
4,753,208 6/1988 Yamato et al. ..... 123/489
4,763,629 8/1988 Okazaki et al. ..... 123/489
4,793,312 12/1988 Doinaga et al. ..... 123/489
4,877,006 10/1989 Noguchi et al. ..... 123/489 X
4,936,278 6/1990 Umeda ..... 123/489

FOREIGN PATENT DOCUMENTS 0024435 2/1982 Japan .
0128941 7/1984 Japan .

*Primary Examiner*—Willis R. Wolfe
*Attorney, Agent, or Firm*—Arthur L. Lessler

[57] ABSTRACT

A method of controlling the air-fuel ratio of an air-fuel mixture supplied to an internal combustion engine including the step of interrupting the feedback control of the air-fuel ratio responsive to a detected value of the concentration of an exhaust gas ingredient after a high load operating condition of the engine in which a detected load on the engine is above a predetermined reference value has continued over a predetermined time period. Calculation is made of a value of a parameter dependent on a ratio of a time period over which the detected load on the engine continued to be above a predetermined value to a time period over which the detected load on the engine continued to be below the predetermined value. The predetermined time is set based on the calculated value of the parameter dependent on the ratio. The predetermined value may be equal to the predetermined reference value, or alternatively may be smaller than the predetermined reference value. Alternatively, the rotational speed of the engine may be detected and counting of the predetermined time period is started when the detected rotational speed of the engine exceeds a predetermined value during the feedback control of the air-fuel ratio.

12 Claims, 19 Drawing Sheets

FUEL INJECTION VALVE
INTERNAL COMBUSTION ENGINE
THREE-WAY CATALYST
O2
CYL
Ne
TW
TA
PBA
θTH
PA
INPUT CIRCUIT
C P U
MEMORY MEANS
OUTPUT CIRCUIT
E C U
1
2
3
3'
4
5
5a
5b
5c
5d
6
7
8
9
10
11
12
13
14
15
16

| t | tWOTX |
|---|---|
| t1 | $t_{WOTX1} = T_{BASE} = 30$ |
| t3 | $t_{WOTX2} = t_{WOTX1} - (T_1 - T_2) = 30 - (15 - 10) = 25$ |
| t6 | $t_{WOTX3} = t_{WOTX2} - (T_3 + T_4 - T_5) = 25 - (30 - 15) = 10$ MAXIMUM VALUE ($T_{BASE}$) |
| t8 | $t_{WOTX4} = t_{WOTX3} - (T_6 - T_7) = 10 - (5 - 20) = 25$ |
| t10 | $t_{WOTX5} = t_{WOTX4} - (T_8 - T_9) = 25 - (20 - 10) = 15$ |

AIR-FUEL RATIO CONTROL METHOD FOR INTERNAL COMBUSTION ENGINES

BACKGROUND OF THE INVENTION

This invention relates to an air-fuel ratio control method for internal combustion engines, and more particularly to a method of this kind which is adapted to control the air-fuel ratio of the engine under a high load operating condition.

Conventionally, there has been employed an air-fuel ratio control method which controls the air-fuel ratio of a mixture supplied to an internal combustion engine to a stoichiometric ratio or a value close thereto by means of feedback control when the engine is under a low or middle load condition, and interrupt the feedback control and enriches the mixture when the engine shifts into a higher load condition to thereby prevent an excessive rise in the temperature of the engine by so-called cooling-by-fuel. However, this method has suffered from drawbacks, such as increased fuel consumption and degraded exhaust emission characteristics.

In order to eliminate such drawbacks, a method has been proposed, e.g. by Japanese Provisional Patent Publication (Kokai) No. 59-128941, which makes the mixture leaner than a required rich air-fuel ratio for a predetermined time period after the engine operating condition has shifted to a predetermined high load operating condition, and enriches the mixture to the required rich air-fuel ratio after the lapse of the predetermined time period, and a method by Japanese Provisional Patent Publication (Kokai) No. 57-24435, which enriches the mixture after a predetermined high load operating condition of the engine has continued for a predetermined time period.

In general, if the so-called feedback control region, in which the air-fuel ratiO is controlled to a stoichiometric ratio or a value close thereto by means of feedback control, is expanded toward the higher load side in order to improve the exhaust emission characteristics, the amount of the mixture supplied to the engine increases when the engine is operating under a relatively high load condition within the feedback control region, so that the amount of heat generated by the engine increases to increase the temperature of exhaust gases. However, according to the above prior art method employing leaning of the mixture before the lapse of the predetermined time period, the mixture is enriched after the predetermined time period has elapsed from the time the engine operating condition shifted to the predetermined high load operating condition. Therefore, if the engine operating condition has shifted to the predetermined high load operating condition after the engine continued operating under the relatively high load condition within the feedback control region, the temperature of exhaust gases becomes very high before the predetermined time period elapses, which shortens the life of an exhaust gas-purifying device arranged in the exhaust pipe of the engine.

Further, according to the above-mentioned prior art method employing enriching of the mixture after the lapse of the predetermined time period, the mixture is not enriched to such an extent as to effect cooling-by-fuel if the engine intermittently operates under the high load condition over time periods each of which is shorter than the predetermined time period, as shown in (1 ) of (a) of FIG. 13 (in which the high load operating condition is defined as a condition that an engine operating condition parameter for determining the high load operating condition is above a critical value). Accordingly, the temperature of exhaust gases continues to rise as shown in (2) of (a) of FIG. 13. As a result, the temperature of exhaust gases can exceed the maximum allowable continuous temperature for exhaust gases, and even further rise, without falling below the maximum allowable continuous temperature within the maximum allowable time period during which the engine can withstand a temperature between the maximum allowable continuous temperature and a limit temperature, so that in the worst case it rises above the limit temperature. In particular, this causes an excessive rise in the temperature of a catalyst of the exhaust gas-purifying device.

SUMMARY OF THE INVENTION

It is the object of the invention to provide an air-fuel ratio control method for an internal combustion engine which is capable of properly controlling the air-fuel ratio of a mixture supplied to the engine when it is under a high load operating condition, to thereby decrease the amounts of emission of the exhaust gas ingredients of CO and HC and improve the fuel consumption, and preventing excessive rise in the temperature of exhaust gases as well as the catalyst temperature of the exhaust gas-purifying device.

To attain the above object, the invention provides a method of controlling the air-fuel ratio of an air-fuel mixture supplied to an internal combustion engine having an exhaust system having an exhaust gas ingredient concentration sensor arranged therein, including the steps of:

detecting load on the engine;

detecting a value of the concentration of an exhaust gas ingredient by the exhaust gas ingredient concentration sensor;

carrying out feedback control of the air-fuel ratio of the air-fuel mixture to a predetermined value in response to the value of the concentration of the exhaust gas ingredient detected by the exhaust gas ingredient concentration sensor; and interrupting the feedback control of the air-fuel ratio of the air-fuel mixture and enriching the air-fuel ratio of the air-fuel mixture after a high load operating condition of the engine in which the detected load on the engine is above a predetermined reference value has continued over a predetermined time period.

According to a first aspect of the invention, the method is characterized by comprising the steps of:

(1) calculating a value of a parameter dependent on a ratio of a time period over which the detected load on the engine continued to be above a predetermined value to a time period over which the detected load on the engine continued to be below the predetermined value; and (2) setting the predetermined time period based on the calculated value of the parameter dependent on the ratio.

Preferably, the predetermined time period is calculated whenever the detected load on the engine exceeds the predetermined value, by the following equation:

$$t_{WOTX(n)} = t_{WOTX(n-1)} + (t_{FB} - t_{WOT})$$

where $t_{WOTX(n)}$ represents a present value of the predetermined time period;

$t_{WOTX(n-1)}$ represent an immediately preceding value of the predetermined time period;

$t_{FB}$ represents a time period, over which the detected load on the engine continued to be below the predetermined value, between a time point of calculation of the immediately preceding value of the predetermined time period and a time point of calculation of the present value of the predetermined time period; and $t_{WOT}$ represents a time period, over which the detected load on the engine continued to be above the predetermined value, between the time point of calculation of the immediately preceding value of the predetermined time period and the time point of calculating of the present value of the predetermined time period.

Preferably, the predetermined value is equal to the predetermined reference value.

Alternatively, the predetermined value is smaller than the predetermined reference value According to a second aspect of the invention, the method is characterized by comprising the step of starting counting the predetermined time period when the detected load on the engine exceeds a predetermined value lower than the predetermined reference value during the feedback control of the air-fuel ratio.

According to a third aspect of the invention, the method is characterized by comprising the steps of:

(1) detecting the rotational speed of the engine; and (2) starting counting the predetermined time period when the detected rotational speed of the engine exceeds a predetermined value during the feedback control of the air-fuel ratio.

Preferably, in the above aspects of the invention, the air-fuel ratio of the air-fuel mixture is enriched immediately when the detected load on the engine exceeds a predetermined high load value higher than the predetermined reference value, and is further enriched after the predetermined time period elapses.

Further preferably, the method according to the above aspects of the invention includes the steps of detecting the rotational speed of the engine, a temperature of the engine, and atmospheric pressure, and the predetermined reference value is set to a value depending on the detected rotational speed of the engine, the detected temperature of the engine, and the detected atmospheric temperature.

Preferably, the method according to the first and second aspects of the invention includes the step of detecting a temperature of the engine, and wherein the air-fuel ratio of the air-fuel mixture is enriched to a degree depending on the detected temperature of the engine.

The above and other objects, features, and advantages of the invention will be more apparent from the ensuing detailed description taken in conjunction with the accompanying drawings.

BRIEF DESCRIPTION OF THE DRAWINGS

FIGS. 20, *a–c* are a diagram showing an example of setting of the high load-dependent incremental coefficient ($K_{WOT}$) in Region Ib in FIG. 19 and FIGS. 21, *a–c* are a diagram showing an example of setting of the high load-dependent incremental coefficient ($K_{WOT}$) in Regions ($c_1$ and $Ic_2$.

DETAILED DESCRIPTION

The invention will now be described in detail with reference to the drawings showing embodiments thereof.

Figure 1:
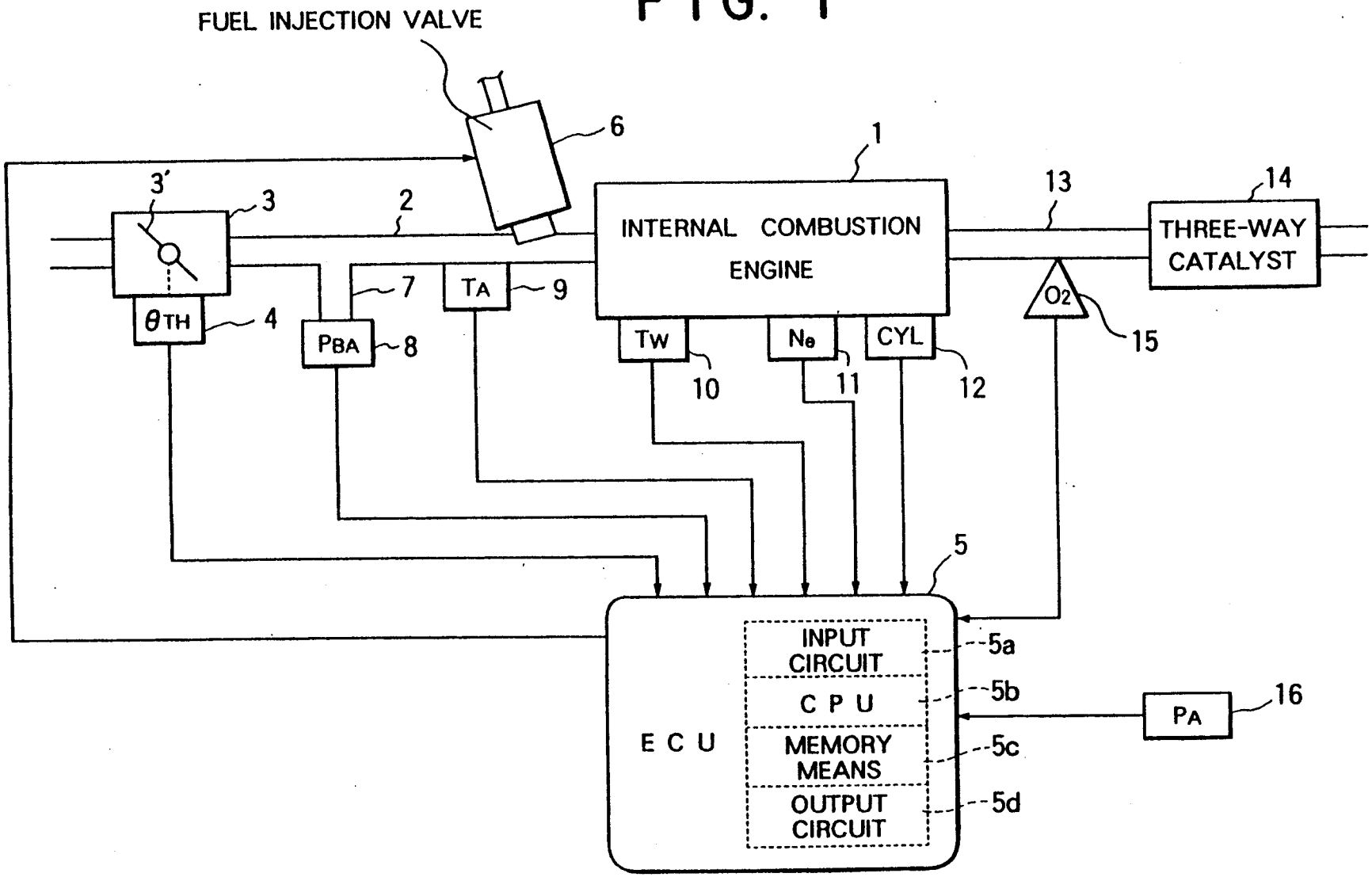
FIG. 1 is a block diagram illustrating the whole arrangement of a fuel supply control system for carrying out the method of the invention.

Referring first to FIG. 1, there is shown the whole arrangement of a fuel supply control system for an internal combustion engine, which is adapted to carry out the method according to the invention. In the figure, reference numeral 1 designates an internal combustion engine for automotive vehicles. Connected to the cylinder block of the engine 1 is an intake pipe 2 across which is arranged a throttle body 3 accommodating a throttle valve 3' therein. A throttle valve opening ($\theta_{TH}$) sensor 4 is connected to the throttle valve 3' for generating an electric signal indicative of the sensed throttle valve opening and supplying same to an electronic control unit (hereinafter called "the ECU") 5.

Fuel injection valves 6, only one of which is shown, are inserted into the interior of the intake pipe at locations intermediate between the cylinder block of the engine 1 and the throttle valve 3' and slightly upstream of respective intake valves, not shown. The fuel injection valves 6 are connected to a fuel pump, not shown, and electrically connected to the ECU 5 to have their valve opening periods controlled by signals therefrom.

On the other hand, an intake pipe absolute pressure ($P_{BA}$) sensor 8 is provided in communication with the interior of the intake pipe 2 at a location immediately downstream of the throttle valve 3' for supplying an electric signal indicative of the sensed absolute pressure within the intake pipe 2 to the ECU 5. An intake air temperature ($T_A$) sensor 9 is inserted into the intake pipe 2 at a location downstream of the intake pipe absolute pressure sensor 8 for supplying an electric signal indicative of the sensed intake air temperature $T_A$ to the ECU 5.

An engine coolant temperature ($T_W$) sensor 10, which may be formed of a thermistor or the like, is mounted in the cylinder block of the engine 1, for supplying an electric signal indicative of the sensed engine coolant temperature $T_W$ to the ECU 5. An engine rotational speed (Ne) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse at each of predetermined crank angles whenever the crankshaft rotates through 180 degrees, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO, and NO. An $O_2$ sensor 15 as an exhaust gas ingredient concentration sensor is mounted in the exhaust pipe 13 at a location upstream of the three-way catalyst 14, for sensing the concentration of oxygen present in exhaust gases emitted from the engine 1 and supplying an electric signal indicative of the sensed oxygen concentration tO the ECU 5.

Further electrically connected to the ECU 5 is an atmospheric pressure ($P_A$) sensor 16 for supplying an electric signal indicative of the sensed atmospheric pressure $P_A$.

The ECU 5 comprises an input circuit 5a having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") 5b. memory means 5c storing various operational programs which are executed in the CPU 5b and for storing results of calculations therefrom, etc., and an output circuit 5d which outputs a driving signal to the fuel injection valves 6.

15 The CPU 5b operates in response to the above-mentioned signals from the sensors to determine operating conditions in which the engine 1 is operating, such as an air-fuel ratio feedback control region in which the fuel supply is controlled in response to the detected oxygen concentration in the exhaust gases, and open-loop control regions, and calculates, based upon the determined operating conditions, the valve opening period or fuel injection period $T_{OUT}$. Over which the fuel injection valves 6 are to be opened, by the use of the following equation in synchronism with inputting of TDC signal pulses to the ECU 5.

$$T_{OUT}=T_i\times K_{WOT}\times K_{TW}\times K_{02}\times K_1+K_2 \quad (1)$$

where $T_i$ represents a basic value of the fuel injection period $T_{OUT}$ of the fuel injection valves 6, which is read from a Ti map set in accordance with the engine rotatiOnal speed Ne and the intake pipe absolute pressure $P_{BA}$. $K_{WOT}$ is a high load-dependent incremental coefficient for enriching the mixture when the throttle valve 3' is substantially fully open, which is set in a manner described in FIG. 2, referred to hereinbelow.

$K_{02}$ is an air-fuel ratio feedback control correction coefficient whose value is determined in response to the oxygen concentration in the exhaust gases during feedback control, while it is set to respective predetermined appropriate values while the engine is in predetermined operating regions (the open-loop control regions) other than the feedback control region.

$K_1$ and $K_2$ are other correction coefficients and correction variables, respectively, which are calculated based on various engine parameter signals to such values as to optimize characteristics of the engine such as fuel consumption and accelerability depending on the operating conditions of the engine.

The CPU 5b supplies through the output circuit 5d the fuel injection valves 6 with driving signals corresponding to the calculated fuel injection period $T_{OUT}$ determined as above, over which the fuel injection valves 6 are opened.

Figure 2A:
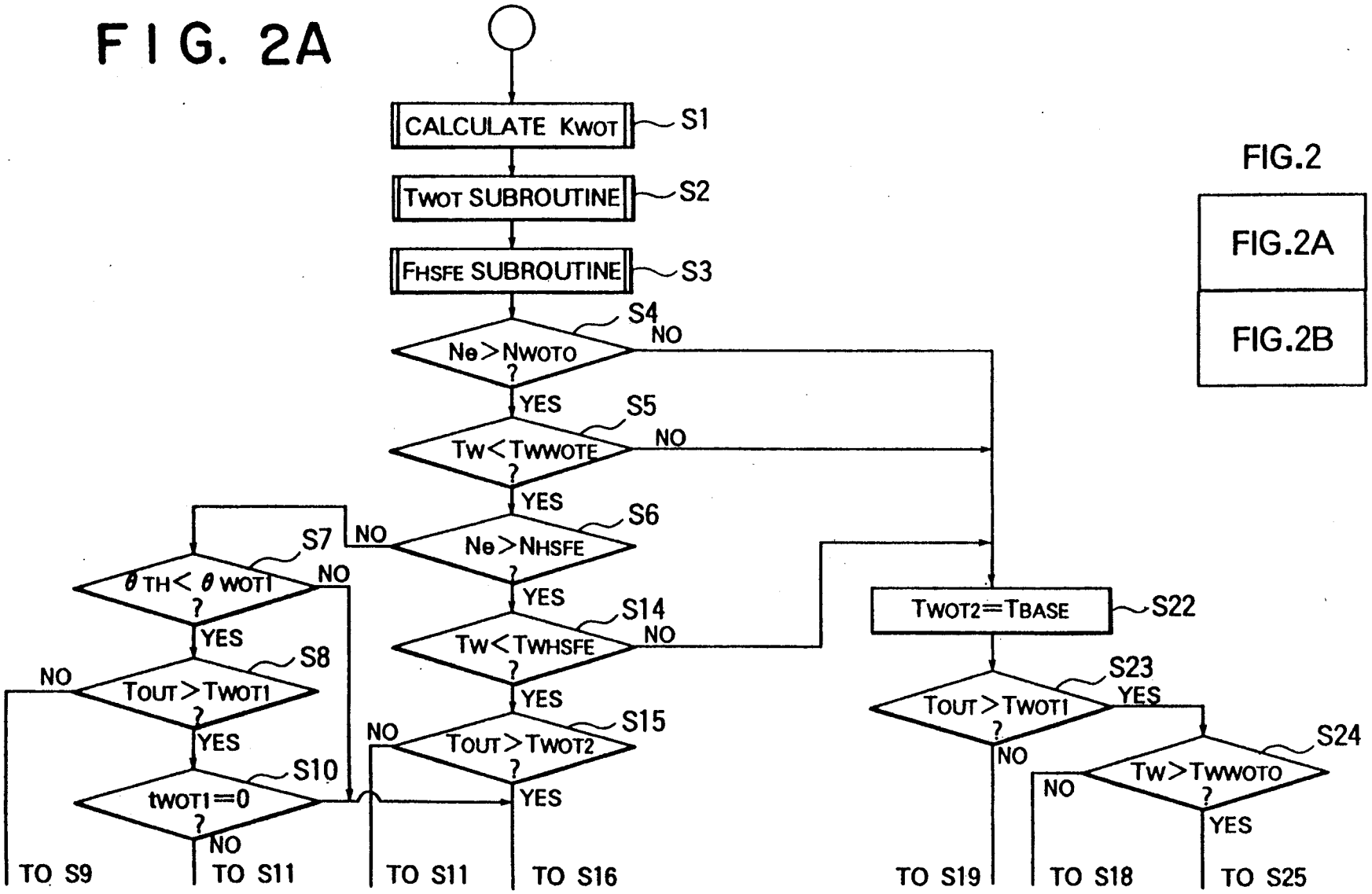
FIG. 2 is a flowchart of a subroutine for setting a high load-dependent incremental coefficient $K_{WOT}$)
Figure 2B:
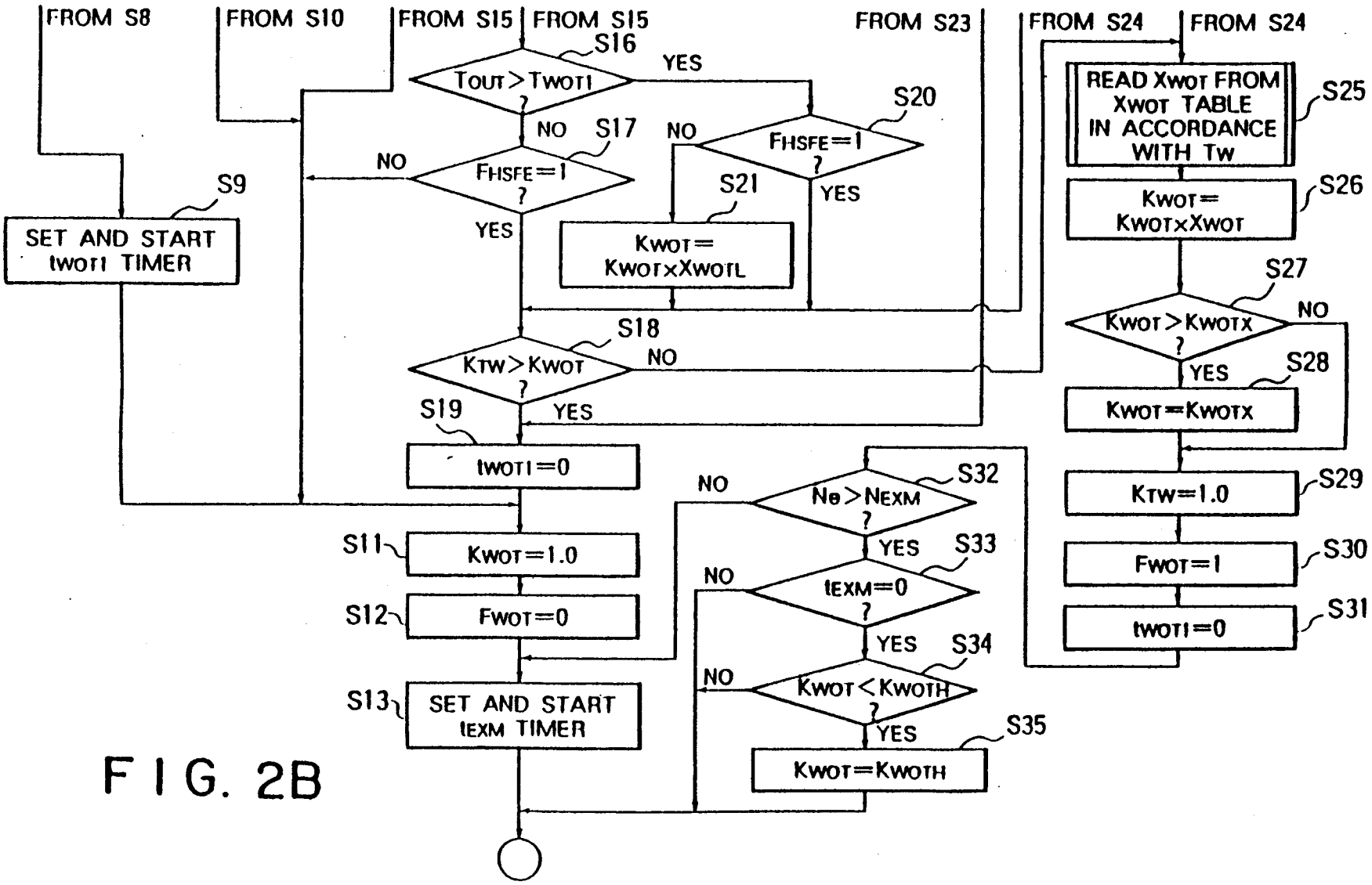

FIG. 2 shows a subroutine for calculating the high load-dependent incremental coefficient $K_{WOT}$. This program is carried out in synchronism with inputting of each TDC signal pulse to the ECU 5.

At a step S1, an interpolative coefficient $C_{WOT}$ depending on the engine rotational speed Ne and the absolute pressure within the intake pipe and stored in the Ti map together with the basic value Ti of the fuel injection time period is applied to the following equation to calculate the high load-dependent incremental coefficient $K_{WOT}$:

$$K_{WOT}=1+C_{WOT}/32 \quad (2)$$

Figure 3:
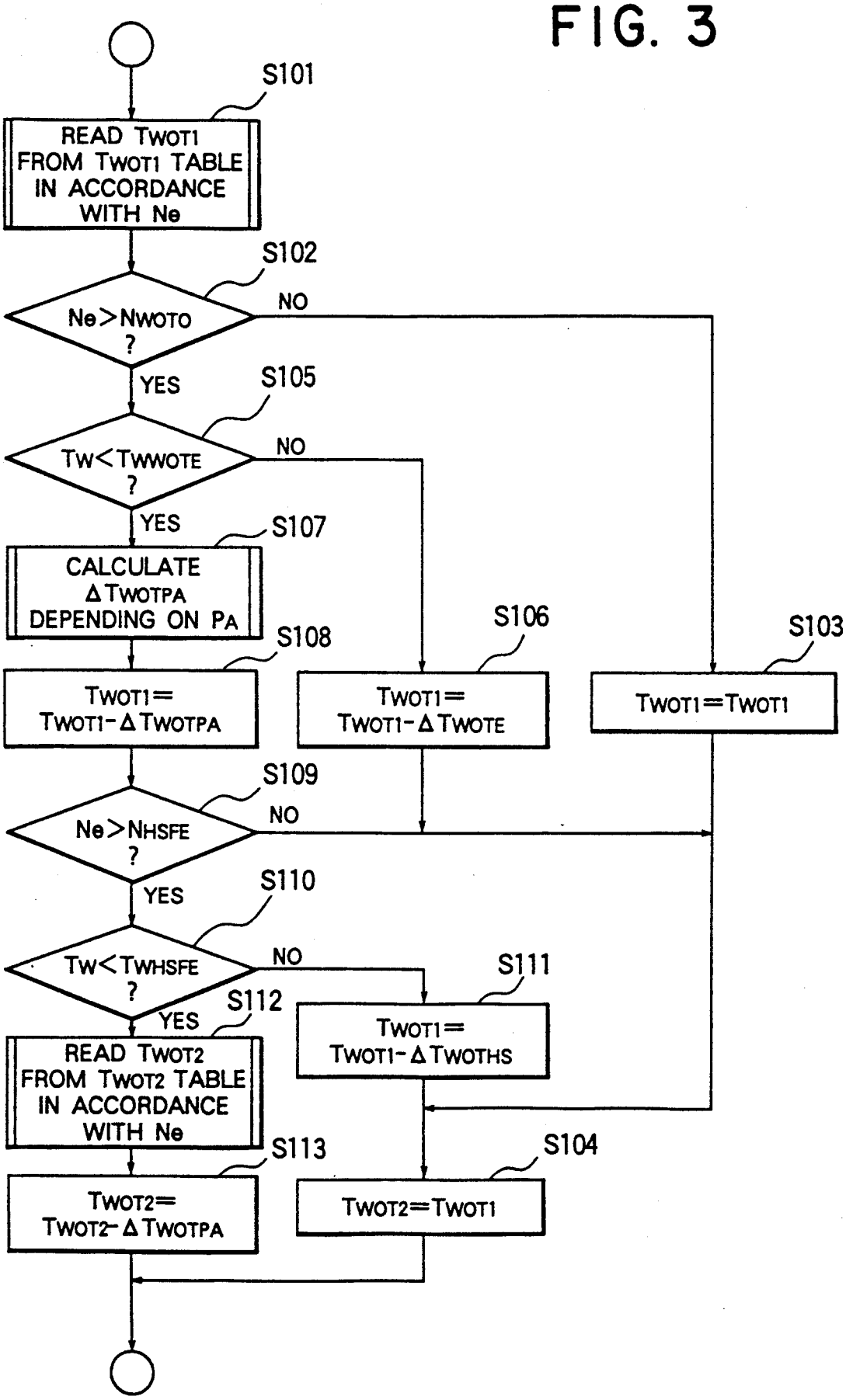
FIG. 3 is a flowchart of a subroutine for setting a reference value ($T_{WOT}$) used in the subroutine of FIG. 2.

At a step S2, a $T_{WOT}$ subroutine shown in FIG. 3 is executed for calculating a reference value $T_{WOT}$ for determining an engine operating region (hereinafter referred to as "the WOT region") in which fuel supply should be increased due to high load on the engine.

In FIG. 3, first at a step S101, a first reference value $T_{WOT1}$ is read from a $T_{WOT1}$ table in accordance with the engine rotational speed Ne. The $T_{WOT1}$ table is set such that first reference values $T_{WOT10}$ to $T_{WOT15}$ correspond to predetermined values $N_{WOTO}$ to $NT_{WOT5}$ respectively. If $Ne<N_{WOTO}$ or $Ne>N_{WOT5}$, the first reference value $T_{WOT1}$ is set to $T_{WOT10}$ or $T_{WOT15}$, respectively. If $N_{WOTO}<Ne<N_{WOT5}$, the first reference value $T_{WOT1}$ is calculated by interpolation with respect to engine rotational speeds other than the predetermined values $T_{WOT1}$ to $T_{WOT4}$.

At a step S102, it is determined whether or not the engine rotational speed Ne is higher than the first predetermined value $N_{WOTO}$ e.g. 600 rpm). If the answer to this question is negative (No), i.e. if $Ne\leqq N_{WOTO}$, the first reference value $T_{WOT1}$ is set to the value obtained at the step S101 at a step S103, and a second reference value $T_{WOT2}$ is set to the same value as the first reference value $T_{WOT1}$ at a step S104, followed by terminating the present program.

If the answer to the question of the step S102 is affirmative (Yes), i.e. if $Ne>N_{WOTO}$, it is determined at a step S105 whether or not the engine coolant temperature $T_W$ is lower than a first predetermined value $T_{WWOTE}$ (e.g. 114° C.). If the answer to this question is negative, i.e. if $T_W \geqq T_{WWOTE}$, the first reference value $T_{WOT1}$ is set at a step S106 to a value obtained by subtracting a first predetermined amount $\Delta T_{WOTE}$ from the value obtained at the step S101, and then the program proceeds to the step S104. As described in detail hereinafter, it is determined that the engine is in the WOT region when the fuel injection period $T_{OUT}$ exceeds the reference value $T_{WOT1}$ or $T_{WOT2}$. By subtracting the first predetermined amount $\Delta T_{WOTE}$ from the first reference value $T_{WOT1}$, the WOT region is expanded. Since the mixture is enriched in the WOT region to cool the engine, an excessive rise in the engine temperature can be prevented by the expansion of the WOT region.

Figure 7:
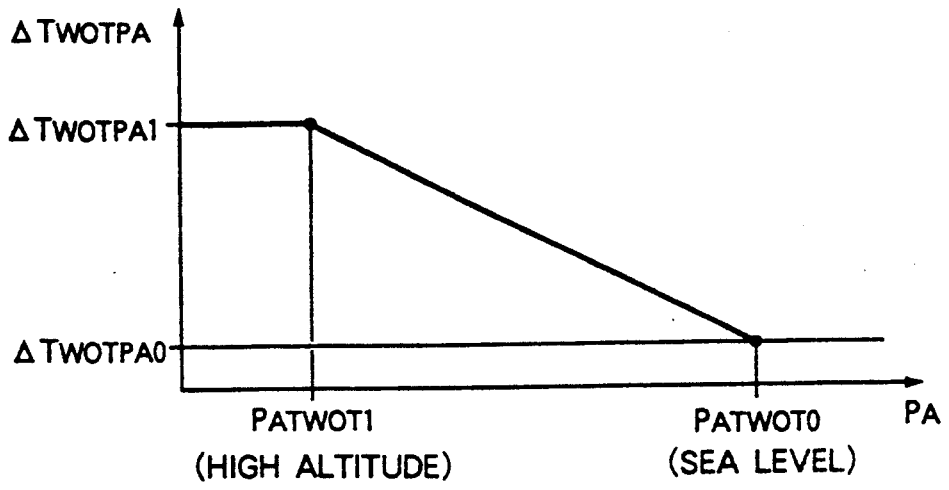
FIG. 7 is a diagram showing a table for calculating an atmospheric pressure-dependent correction amount ($\Delta T_{WOTPA}$)

If both the answers to the questions of the steps S102 and S105 are affirmative {Yes), i.e. if $Ne > N_{WOTO}$ and $T_W < T_{WWOTE}$, an atmospheric pressure-dependent correction amount $\Delta T_{WOTPA}$ is calculated at a step S107 from a $\Delta T_{WOTPA}$ table in accordance with atmospheric pressure. The $\Delta T_{WOTPA}$ table is set, as shown in FIG. 7, such that in the range of $P_A < P_{ATWOT1}$ (a predetermined pressure level corresponding to atmospheric pressure at a high altitude), the atmospheric pressure-dependent correction amount $T_{WOTPA}$ is set to a value $\Delta T_{TWOTPA1}$, in the range of $P_A > P_{ATWOTO}$ (a predetermined pressure level corresponding to atmospheric pressure at sea level), the $\Delta T_{WOTPA}$ is set to a value $\Delta T_{WOTPAO}$, and in the range of $P_{ATWOT1} < P_A < P_{ATWOTO}$, the value $\Delta T_{WOTPA}$ gradually decreases as the atmospheric pressure $P_A$ rises.

Then at a step S108, the first reference value $T_{WOT1}$ is set to a value obtained by subtracting the atmospheric pressure-dependent correction amount $\Delta T_{WOTPA}$ from the value obtained at the step S101. Thus, the WOT region is expanded as the atmospheric pressure decreases.

At a step S109, it is determined whether or not the engine rotational speed Ne is higher than a reference value $N_{HSFE}$ (e.g. 2,500 rpm). If the answer to this question is negative (No), i.e. if $Ne \leqq N_{HSFE}$, the program proceeds to the step 104, whereas if the answer is affirmative (Yes), i.e. if $Ne > N_{HSFE}$, it is determined at a step S110 whether or not the engine coolant temperature $T_W$ is lower than a second predetermined value $T_{WHSFE}$ (e.g. 100° C.) which is lower than the first predetermined value $T_{WWOTE}$. If the answer to this question is negative (No), i.e. if $T_W \geqq T_{WHSFE}$, the first reference value $T_{WOT1}$ is set at a step S111 to a value obtained by further subtracting a second predetermined amount $\Delta T_{WOTHS}$ from the value obtained at the step S108, and the program proceeds to the step S104. This subtraction is also intended to prevent an excessive rise in the engine temperature, similarly to the subtraction carried out at the step S106.

Figure 6:
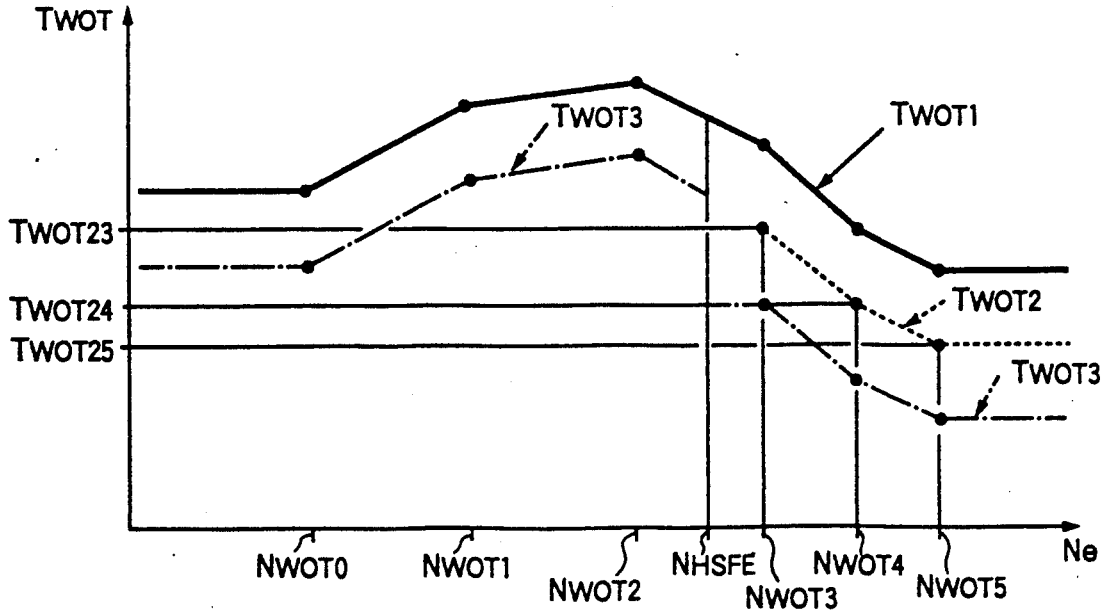
FIG. 6 is a diagram showing a table for calculating a second reference value ($T_{WOT2}$) and the relationship between the second reference value and the other reference values ($T_{WOT1}$, $T_{WOT3}$)

If both the answers to the questions of the steps S109 and S110 are affirmative (Yes), i.e. if $Ne > N_{HSFE}$ and $T_W < T_{WHSFE}$, the second reference value $T_{WOT2}$ is read at a step S112 from a $T_{WOT2}$ table in accordance with the engine rotational speed Ne. The $T_{WOT2}$ table is set with respect to an engine rotational speed range which is higher than the reference value $N_{HSFE}$, for example, as indicated by the broken line in FIG. 6. The second reference value $T_{WOT2}$ is set such that in the range of $N_{HSFE} < Ne \leqq N_{WOT3}$, the value $T_{WOT2}$ is set to $T_{WOT23}$, at $Ne = N_{WOT4}$, the value $T_{WOT2}$ is set to $T_{WOT24}$, in the range of $Ne \geqq N_{WOT5}$, the value $T_{WOT2}$ is set to $T_{WOT25}$, and in the range of $N_{WOT3} < Ne < N_{WOT4}$ or $N_{WOT4} < Ne < N_{WOT5}$, the value $T_{WOT2}$ is obtained by interpolation. As is clear from FIG. 6, with respect to the same engine rotational speed, the second reference value $T_{WOT2}$ set in the $T_{WOT2}$ table is smaller than the first reference value $T_{WOT1}$ set in the $T_{WOT1}$ table. In this connection, $T_{WOT3}$ shown in FIG. 6 is a third reference value used in a third embodiment of the invention, described hereinafter.

Then at a step S113, the second reference value $T_{WOT2}$ is set to a value obtained by subtracting the atmospheric pressure-dependent correction amount $\Delta T_{WOTPA}$ from the value obtained at the step S112, followed by terminating the present program.

According to the above-described $T_{WOT}$ subroutine, when the engine coolant temperature $T_W$ is lower than the second predetermined value $T_{WHSFE}$, the first and second reference values $T_{WOT1}$ and $T_{WOT2}$ are set to different values ($T_{WOT1} > T_{WOT2}$) in the range of $Ne > N_{HSFE}$, whereas the are set to the same value in the range of $Ne \leqq N_{HSFE}$. When the engine coolant temperature $T_W$ is equal to or higher than the second predetermined value $T_{WHSFE}$, the first and second reference values $T_{WOT1}$ and $T_{WOT2}$ are set to the same value irrespective of the engine rotational speed Ne.

Figure 4:
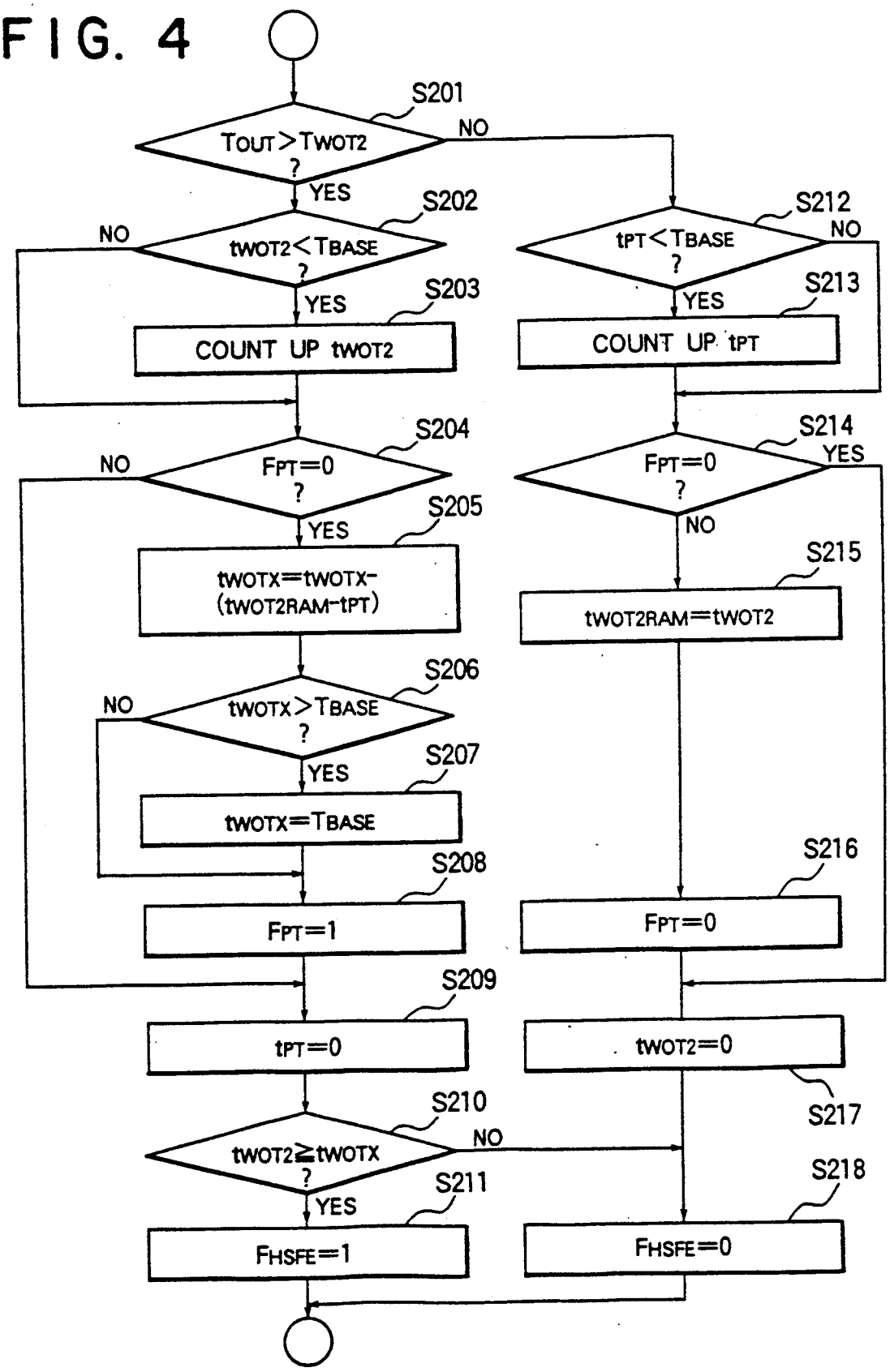
FIG. 4 is a flowchart of a subroutine for setting a flag ($F_{HSFE}$) used in the subroutine of FIG. 2.

Referring again to FIG. 2, at a step S3, a $F_{HSFE}$ subroutine shown in FIG. 4 is executed. The $F_{HSFE}$ subroutine is carried out for setting a first flag $F_{HSFE}$ used for changing over the fuel increment in the WOT region in steps S17 and S20, referred to hereinafter.

In FIG. 4, it is determined at a step S201 whether or not the fuel injection period $T_{OUT}$ obtained by the equation (1) is longer than the second reference value $T_{WOT2}$. If the answer to this question is affirmative (Yes), i.e. if $T_{OUT} > T_{WOT2}$, which means that the engine operating condition is in the WOT region, it is determined at a step S202 whether or not the counted value of a $t_{WOT2}$ timer is smaller than a reference time period $T_{BASE}$ (e.g. 30 seconds). If the answer to this question is affirmative (Yes), i.e. if $t_{WOT2} < T_{BASE}$, the $t_{WOT2}$ timer is caused to count up at a step S203, and then the program proceeds to a step S204, whereas if the answer is negative (No), i.e. if $t_{WOT2} \geqq T_{BASE}$, program jumps to the step S204. By the steps S201 to S203, in the WOT region where the condition of $T_{OUT} > T_{WOT2}$ is satisfied, the $T_{WOT2}$ timer is caused to count up until the reference time period $T_{BASE}$ is reached.

At the step S204, it is determined whether or not a second flag $F_{PT}$ is equal to 0. If the answer to this question is negative (No), i.e. if $F_{PT} = 1$, the program jumps to a step S209, whereas if the answer is affirmative (Yes), i.e. if $F_{PT} = 0$, the program proceeds to a step S205. In this connection, the second flag $F_{PT}$ is set to 0 when the answer to the question of the step S201 is negative, i.e the condition of $T_{OUT} \leqq T_{WOT2}$ is satisfied, which means that the engine operating condition is outside the WOT region. Therefore, if both the answers to the questions of the steps S201 and S204 are affirmative, it means that the engine operating condition has just shifted from outside the WOT region into the WOT region.

At the step 205, an integrated time period $T_{WOTX}$ is calculated by the following equation (3):

$$t_{WOTX} = t_{WOTX} - (t_{WOT2RAM} - t_{PT}) = t_{WOTX} + (t_{PT} - t_{WOT2RAM}) \quad (3)$$

The integrated time period $t_{WOTX}$ is obtained by adding up a time period obtained by subtracting a time period over which the engine operating condition was in the WOT region (the condition of $T_{OUT} > T_{WOT2}$ was satisfied) on the last occasion from a time period over which the engine operating condition was outside the WOT region (the condition of $T_{OUT} \leqq T_{WOT2}$ was satisfied) on the last occasion.

Then, it is determined at a step 206 whether or not the integrated time period $t_{WOTX}$ obtained at the step S205 is longer than the reference time period $T_{BASE}$. If the answer to this question is negative (No), i.e. if $t_{WOTX} > T_{BASE}$, the integrated time period $t_{WOTX}$ is set at a step S207 to the reference time period $T_{BASE}$, and then the program proceeds to the step 208. By the steps S206 and S207, the maximum value of the integrated time period $t_{WOTX}$ is set to the reference time period $T_{BASE}$. Then, the second flag $F_{PT}$ is set to 1 at the step S208, and the counted value of the $t_{PT}$ timer is reset to 0 at the step S209, followed by determining at a step S210 whether or not the value of the $t_{WOT2}$ timer is equal to or larger than the integrated time period $t_{WOTX}$. If the answer to this question is affirmative (yes), i.e. if $t_{WOT2} \geqq t_{WOTX}$, the first flag $F_{HSFE}$ is set to 1 at a step S211, whereas if the answer is negative (no), i.e. if $t_{WOT2} < t_{WOTX}$, the first flat $F_{HSFE}$ is set to 0 at a step S218, followed by terminating the present program.

On the other hand, if the answer to the question of the step S201 is negative (No), i.e. if $_{TOUT} \leqq T_{WOT2}$, which means that the engine operating condition is outside the WOT region, it is determined at a step S212 whether or not the counted value of the $t_{RT}$ timer is smaller than the reference time period $T_{BASE}$. If the answer to this question is affirmative (Yes), i.e. if $t_{PT} < T_{BASE}$, the $t_{PT}$ timer is caused to count up at a step S213, and then the program proceeds to a step S214, whereas if the answer is negative (No), the program jumps to the step S214. By the steps S201, S212, and S213, when the engine operating condition is outside the WOT region, the $t_{PT}$ timer is caused to count up until the reference time period $T_{BASE}$ is reached.

At the step S214, it is determined whether or not the second flat $F_{PT}$ is equal to 0. If the answer to this question is affirmative (Yes), i.e. if $F_{PT}=0$, the program jumps to a step S217, whereas if the answer is negative (No), i.e. if $F_{PT}=1$, which that the engine operating condition was in the WOT region in the last loop, the counted value of the $t_{WOT2}$ timer is stored at a step S215 as the time period $t_{WOT2RAM}$ in a RAM of the memory means 5c, and the second flag $F_{PT}$ is set to 0 at a step S216, followed by the program proceeding to the step S217. At the step S217, the counted value of the $t_{WOT2}$ timer is reset to 0, and then the first flat $F_{HSFE}$ is set to 0 at a step S218, followed by terminating the present program.

Figure 8:
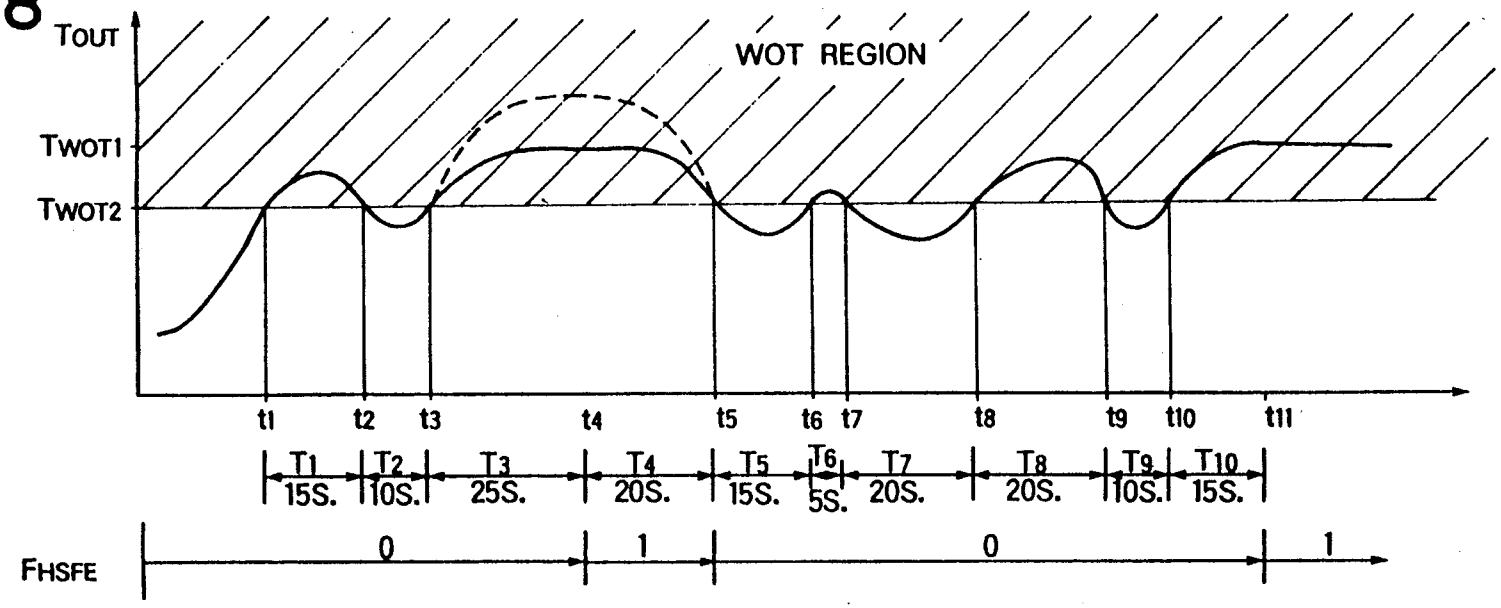
FIGS. 8, *a–c* are a diagram useful in explaining the operation of the subroutine of FIG. 4.

With reference to FIG. 8, the operation according to the program of FIG. 4 will be explained below. The solid line in (a) of FIG. 8 shows an operating condition of the engine in which the fuel injection period $T_{OUT}$ fluctuates in the vicinity of the second reference value $T_{WOTS}$ as time elapses. The integrated time period $t_{WOT2}$ is calculated immediately after the fuel injection period $T_{OUT}$ is shifted from the state of $T_{OUT} \leqq T_{WOTS}$ to the state of $T_{OUT} < T_{WOT2}$ (immediately after the engine operating condition has shifted to the WOT region), i.e. at the time points t1, t3, t6, t8, and t10 of (a) of FIG. 8. The integrated time period $t_{WOTX1}$ to $t_{WOTX5}$ calculated at these time points are as shown in (c) of FIG. 8. $T_1$ to $T_9$ in (c) of FIG. 8 are time periods shown in (a) of same. For example, $T_1$ is a time period between the time points $t_1$ and $t_2$, which is equal to 15 seconds in this embodiment.

At the time point $t_1$, it is assumed that the sum of time periods before the time point $t_1$ during which the condition of $T_{OUT} \leqq T_{WOT2}$ was satisfied is sufficiently longer than the sum of time periods before same during which the condition $T_{OUT} > T_{WOT2}$ was satisfied. Accordingly, the integrated time period $t_{WOTX1}$ at the time point $t_1$ is considered to be equal to the $T_{BASE}$.

At the time point $t_3$, the integrated time period $t_{WOTX1}$ obtained on the last occasion, a time period $T_1$ ($=t_{WOT2RAM}$) over which the engine operating condition continued to be in the WOT region on the last occasion, and a time period T2 ($=t_{PT}$) over which the engine operating condition continued to be outside the WOT region on the last occasion, are applied to the aforementioned equation (3) to obtain an integrated time period $t_{WOTX2}$. In this case, the integrated time period $t_{WOTX2}$ is equal to 25 seconds, so that the first flat $F_{HSFE}$ is changed over from 0 to 1 at a time point $t_4$ when 25 ($=T_3$) have elapsed after the time point $t_3$ (see the steps S210, S211, and S218 in FIG. 4). Thereafter, when the time period $T_{OUT}$ at a time point $t_5$, the first flag $F_{HSFE}$ is changed over from 1 to 0.

At a time point $t_6$, a time period over which the engine operating condition continued to be in the WOT region on the last occasion is 45 seconds ($T_3+T_4$). However, since the maximum counted value of the $t_{WOT2}$ is equal to the reference time period $T_{BASE}$, the integrated time period at the time point $t_6$ is calculated by the use of the reference time period $T_{BASE}$ in place of the time period ($T_3+T_4$) over which the engine operating condition continued to be in the WOT region.

At time points $t_8+t_{10}$, integrated time period $t_{WOTX4}$ and $t_{WOTX5}$ are calculated in the same manner as described above, respectively. Since the integrated time period $t_{WOTX5}$ at the time point $t_{10}$ is 15 seconds, the first flag $F_{HSFE}$ is changed over from 0 to 1 at a time point $t_{11}$ when 15 second ($=T_{10}$) have elapsed after the time point $t_{10}$.

In this connection, if a time period over which the engine operating condition continues to be in the WT region is shorted than the integrated time period $t_{WOTX}$ ($T_1$, $T_6$, and $T_8$ in (a) of FIG. 8), the first flag $F_{HSFE}$ is held at 0.

Thus, according to the subroutine of FIG. 4, until an integrated time period $t_{WOTX}$ has elapsed from a time point the engine operating condition has shifted from outside the WOT region into the WOT region, the integrated time period $t_{WOTX}$ being then calculated, the first flat $F_{HSFE}$ is held at 0, whereas after the integrated time period $t_{WOTX}$ has elapsed and while the engine operating condition is in the WOT region, the first flag $F_{HSFE}$ is held at I.

Figure 5:
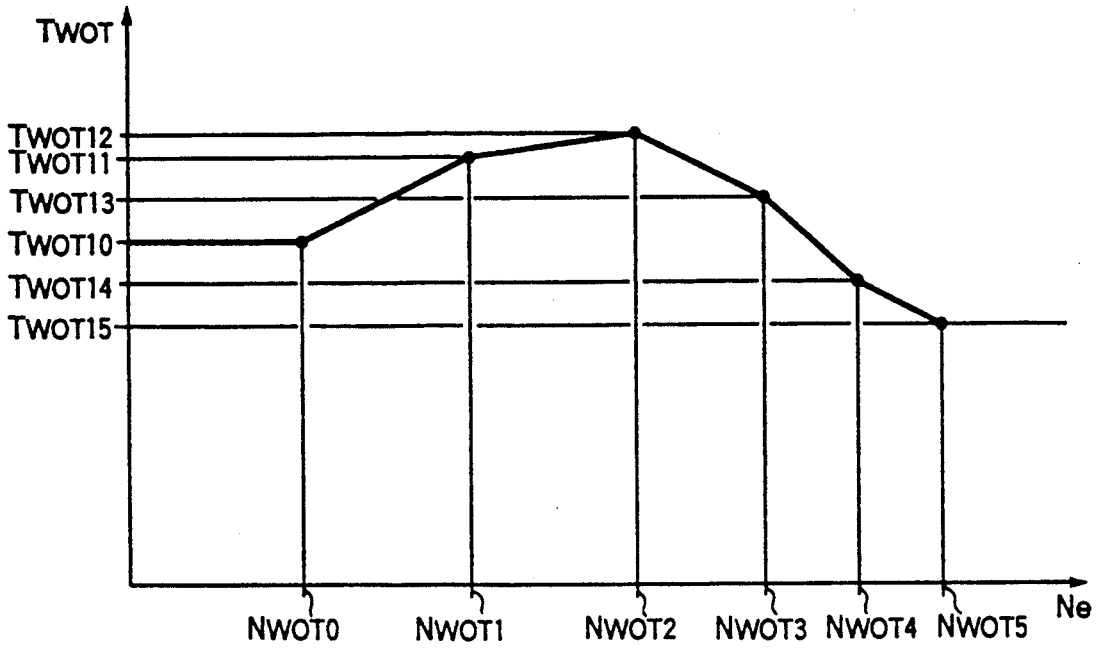
FIG. 5 is a diagram showing a table for calculating a first reference value ($T_{WOT1}$)

Referring again to FIG. 2, after the above-described $F_{HSFE}$ subroutine has been carried out, it is determined at a step S4 whether or not the engine rotational speed Ne is higher than the first predetermined value $N_{WOTO}$ (identical to one in the $T_{WOT1}$ table in FIG. 5). If the answer to this determined at a step S5 whether or not the engine coolant temperature $T_W$ is lower than the first predetermined value $T_{WWOTE}$. If the answer to this question is affirmative (Yes), i.e. if $TW < T_{WWOTE}$, it is determined at a step S6 whether or not the engine rotational speed Ne is higher than the reference value $N_{HSFE}$. If the answer to this question is negative (No), i.e. if $Ne \leqq N_{HSFE}$, it is determined at a step S7 whether or not the throttle valve opening $\theta_{TH}$ is smaller than a predetermined value $\theta$WOT1 (e.g. 50°). If the answer to this question is affirmative (Yes), i e. if $\theta_{TH}<\theta_{WOT1}$, it is determined at a step S8 whether or not the fuel injection period $T_{OUT}$ is longer than the first reference value $T_{WOT1}$. If the answer to this question is negative (No), i.e. if $T_{OUT}\leqq T_{WOT1}$ (Region IIb in FIG. 10), a $t_{WOT1}$ timer, referred to hereinafter, is set to a predetermined time period $t_{WOT1}$ (e.g. 10 seconds) and started at a step S9. Then, a high load-dependent incremental coefficient $K_{WOT}$ is set to 1.0 (non-correction value) at a step S11, and at the same time a third flag $F_{WOT}$ is set to 0 at a step S12 to indicate $K_{WOT}=1.0$. Then, a $t_{EXM}$ timer, referred to hereinafter, is set to a predetermined time period (e.g. 5 minutes) and started at a step S13, followed by terminating the present program. As described above, in Region IIb in FIG. 10, the high load-dependent incremental coefficient $K_{WOT}$ is set to 1.0 in order not to increase the fuel supply.

If the answer to the question of the step S8 is affirmative (Yes), i.e. if $T_{OUT}>T_{WOT1}$ (Region Ib in FIG. 10), it is determined at a step S10 whether or not the down-counted value of the $T_{WOT1}$ timer started at the step S9 is equal to 0. If the answer to the question is negative (No), i.e. if $t_{WOT12}>0$, which means that the predetermined time period $t_{WOT1}$ has not elapsed after the engine operating condition shifted from Region IIb to Region Ib in FIG. 10, the program proceeds to the step S11.

If the answer to the question of the step S7 is negative (No), i.e. if $\theta_{TH}\geqq\theta_{WOT1}$, which means that the throttle valve is substantially fully open, or if the answer to the question of the step S10 is affirmative (Yes), i.e. if $t_{WOT1}=0$, which means that the predetermined time period $t_{WOT1}$ has elapsed after the engine operating condition shifted from Region IIb to Region Ib in FIG. 10, the program proceeds to a step S16 referred to hereinafter.

If the answer tO the question of the step S6 is affirmative (Yes), i.e. if $Ne>N_{HSFE}$, it is determined at a step S14 whether or not the engine coolant temperature $T_W$ is lower than the second predetermined value $T_{WHSFE}$. If the answer to this question is affirmative (yes), i.e. if $TW<T_{WHSFE}$, it is determined at a step S15 whether or not the fuel injection period $T_{OUT}$ is longer than the second reference value $T_{WOT2}$. If the answer to this question is negative (No), i.e. if $T_{OUT}\leqq T_{WOT2}$ (Region IIc in FIG. 10), the program proceeds to the step S11, where the high load-dependent incremental coefficient $K_{WOT}$ is set to 1.0, whereas if the answer is affirmative (Yes), i.e. if $T_{OUT}>T_{WOT2}$, it is determined at a step S16 whether or not the fuel injection period $T_{OUT}$ is longer than the first reference value $T_{WOT1}$.

If the answer to the question of the step S15 is affirmative (Yes) and the answer to the question of the step S16 is negative (No), i.e. if $T_{WOT2}<T_{OUT}\leqq T_{WOT1}$ (Region $Ic_2$ in FIG. 10), it is determined at a step S17 whether or not the first flag $F_{HSFE}$ is equal to 1. If the answer to this question is negative (No), i.e. if $F_{HSFE}=0$, the program proceeds to the step S11, where the high load-dependent incremental coefficient $K_{WOT}$ is set to 1.0, whereas if the answer is affirmative (Yes), i.e. it $F_{HSFE}=1$, it is determined at a step S18 whether or not the engine coolant temperature-dependent incremental coefficient $K_{TW}$ is larger than the high load-dependent incremental coefficient $T_{WOT}$ obtained at the step S1. If the answer to this question is affirmative, i.e. if $K_{TW}>K_{WOT}$, the counted value of the $t_{WOT1}$ timer is set to 0 at a step S19, and then the program proceeds to the step S11. Thus, when the engine temperature is low and the $K_{TW}$ is larger than the $K_{WOT}$ calculated, the $K_{WOT}$ is set to 1.0, i.e. the fuel supply is not increased by the high load-incremental coefficient $K_{WOT}$.

Figure 9:
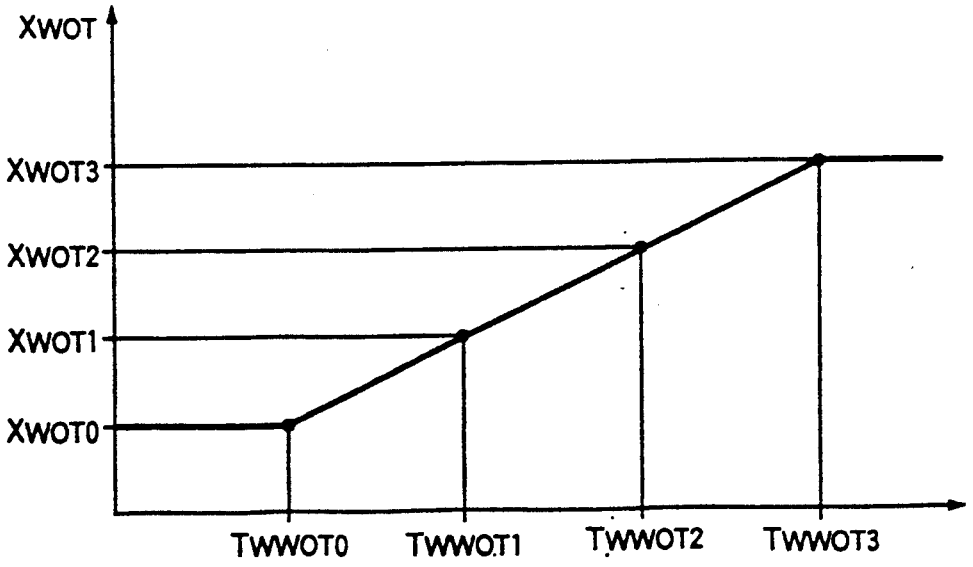
FIG. 9 is a diagram showing a table for calculating an enriching coefficient ($X_{WOT}$)

If the answer to the question of the step S18 is negative (No), i.e. if $K_{TW}\leqq K_{WOT}$, an enriching coefficient $X_{WOT}$ is read at a step S25 from an $X_{WOT}$ table as shown in FIG. 9 in accordance with the engine coolant temperature $T_W$ and at a step S26, the value $K_{WOT}$ obtained at the step S1 (or at a step S21 referred to hereinafter) is multiplied by the enriching coefficient $X_{WOT}$ In the $X_{WOT}$ table, the enriching coefficient $X_{WOT}$ is set such that values $X_{WOTO}$ to $X_{WOT3}$ (e.g. 1.0 to 1.25) of the enriching coefficient $X_{WOT}$ increase as the engine coolant temperature $T_W$ rises. In the ranges of $T<T_{WWOTO}$ and $TW>T_{WWOT3}$, the enriching coefficient $X_{WOT}$ is set to values $X_{WOTO}$ and $X_{WOT3}$, respectively, and in the range of $T_{WWOTO}<T_W<T_{WWOT3}$, with respect to values $T_W$ other than $T_{WWOT1}$ and $T_{WWOT2}$, the enriching coefficient $X_{WOT}$ is calculated by interpolation.

By the steps S25 and S26, when the engine temperature is high, the coefficient $K_{WOT}$ is increased by the enriching coefficient $X_{WOT}$ to thereby further increase the fuel supply so that the engine may be cooled by fuel more effectively and the radiator may be protected.

Then, at a step S27, it is determined whether or not the high load-dependent incremental coefficient increased at the step S26 is larger than the upper limit value $K_{WOTX}$ (e.g. 1.25). If the answer to this question is negative (No), i.e. if $K_{WOT}\leqq K_{WOTX}$, the program jumps to a step S29, whereas if the answer is affirmative (Yes), i.e. if $K_{WOT}>K_{WOTX}$, the $K_{WOT}$ is set to the upper limit value $K_{WOTX}$ at a step S28, and then the program proceeds to the step S29. At the step S29, the engine coolant temperature-dependent incremental coefficient $K_{TW}$ is set to 1.0 (non-correction value), and then the third flag $F_{WOT}$ is set to 1 at a step S30. At a step S31, the counted value of the $t_{WOT1}$ timer is set to 0, and thereafter it is determined at a step S32 whether or not the engine rotational speed Ne is higher than a second predetermined value $N_{EXM}$. If the answer to this question is negative (No), i.e. if $Ne\leqq N_{EXM}$, the program proceeds to the step S13, whereas if the answer is affirmative (Yes), i.e. if $Ne>N_{EXM}$, it is determined at a step S33 whether or not the down-counted value of the $t_{EXM}$ timer started at the step S13 is equal to 0. If the answer to this question is affirmative (Yes), i.e. if $t_{EXM}=0$, which means that the predetermined time period $t_{EXM}$ has elapsed after the engine rotational speed Ne exceeded the second predetermined value N XM, it is determined at a step S34 whether or not the high load-dependent incremental coefficient $K_{WOT}$ is smaller than a predetermined enriching value $K_{WOTH}$ (e.g. 1.25, which makes the air-fuel ratio equal to approximately 11.0). If either of the answers to the questions of the steps S33 and S34 is negative (No), i.e. if $t_{EXM}>0$ or $K_{WOT}\leqq K_{WOTH}$, the program is immediately terminated, whereas if the answer to the question of the step S34 is affirmative (Yes), i.e. if $K_{WOT}<K_{WOTH}$, the coefficient $K_{WOT}$ is set to the predetermined enriching value $K_{WOTH}$ at a step S35, followed by terminating the present program.

By the steps S32 to S35, when high engine rotational speed condition has continued over the predetermined time period $t_{EXM}$, the high load-dependent incremental coefficient $K_{WOT}$ is set to a value equal to or larger than the predetermined enriching value $K_{WOTH}$ to thereby cool the engine by fuel more effectively and hence prevent occurrence of cracks or distortions in the exhaust pipe.

On the other hand, if the answer to the question of the step S16 is affirmative (Yes), i.e. if $T_{OUT}>T_{WOT1}$ (Region $Ic_1$ in FIG. 10), it is determined at a step S20 whether or not the first flag $F_{HSFE}$ is equal to 1. If the answer to this question is affirmative, i.e. if $F_{HSFE}=1$, the program proceeds to the step S18, whereas if the answer is negative (No), i.e. if $F_{HSFE}=0$, the high load-dependent incremental coefficient $K_{WOT}$ obtained at the step S1 is multiplied by a predetermined leaning coefficient $X_{WOTL}$ (e g. 0.93) step S21, and then the program proceeds to the step S18.

If any of the steps S4, S5, and S14 is negative (No), i.e. if $Ne \leqq N_{WOTO}$ or $T_W \geqq T_{WWOTE}$ or $T_W \geqq 4$) is set to the reference time period $T_{BASE}$ at a step S22, and then it is determined at a step S23 whether or not the fuel injection period $T_{OUT}$ is longer than the first reference value $T_{WOTA}$. If the answer to this question is negative (No), i.e. if $T_{OUT} \leqq T_{WOT1}$ (Region IIa in FIG. 10), the program proceeds to the step step S19, whereas if the answer is affirmative (Yes), i.e. if $T_{OUT}>T_{WOT1}$ (Region Ia in FIG. 10), it is determined at a step S24 whether or not the engine coolant temperature $T_W$ is higher than a predetermined value $T_{WWOTO}$ in the $X_{WOT}$ table. If the answer to this question is negative (No.), i e. if $T_W \leqq T_{WWOTO}$, the program proceeds to the step S18, whereas if the answer is affirmative .(Yes), i.e. if $T_W>T_{WWOTO}$, the program proceeds to the step S25.

Figure 10:
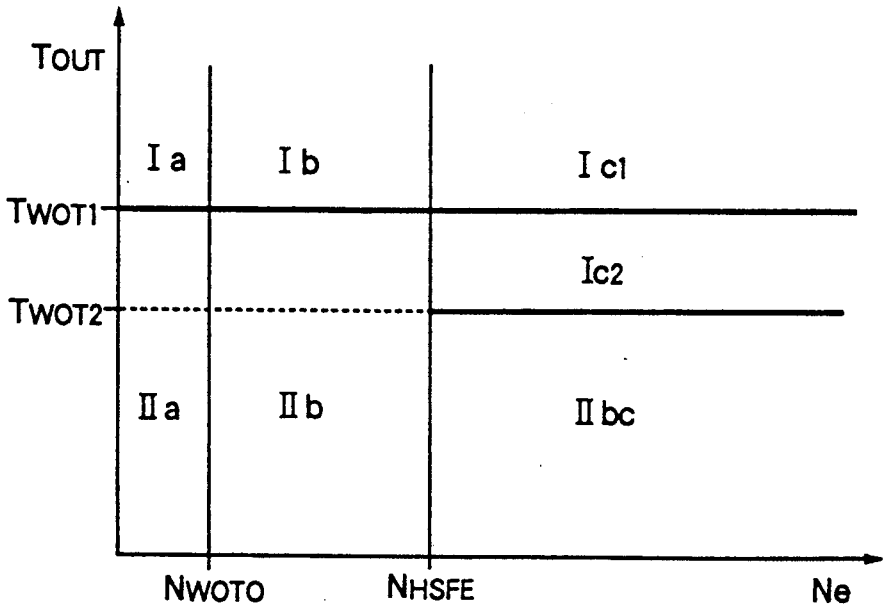
FIG. 10 is a diagram showing operating regions of the engine defined by the engine rotational speed (Ne) and the fuel injection time period ($T_{OUT}$)

According to the program of FIG. 2 described above, the high load-dependent incremental coefficient $K_{WOT}$ is set in the following manner, except when the engine coolant temperature $T_W$ is very high (either of the answers to the questions of the steps S5 and S14 is negative (No.), i.e. $T_W \geqq T_{WOTE}$ or $T_W \geqq T_{WHSFE}$):

(1) In Regions IIa, IIb, and IIc in FIG. 10 (outside the WOT region), $K_{WOT}=1.0$ (non-correction value).

(2) In Region Ia in FIG. 10, $K_{WOT}=K_{WOTO}=X_{WOT}$ ($K_{WOTO}$ is a value of the $K_{WOT}$ calculated at the step S1.)

Figure 11:
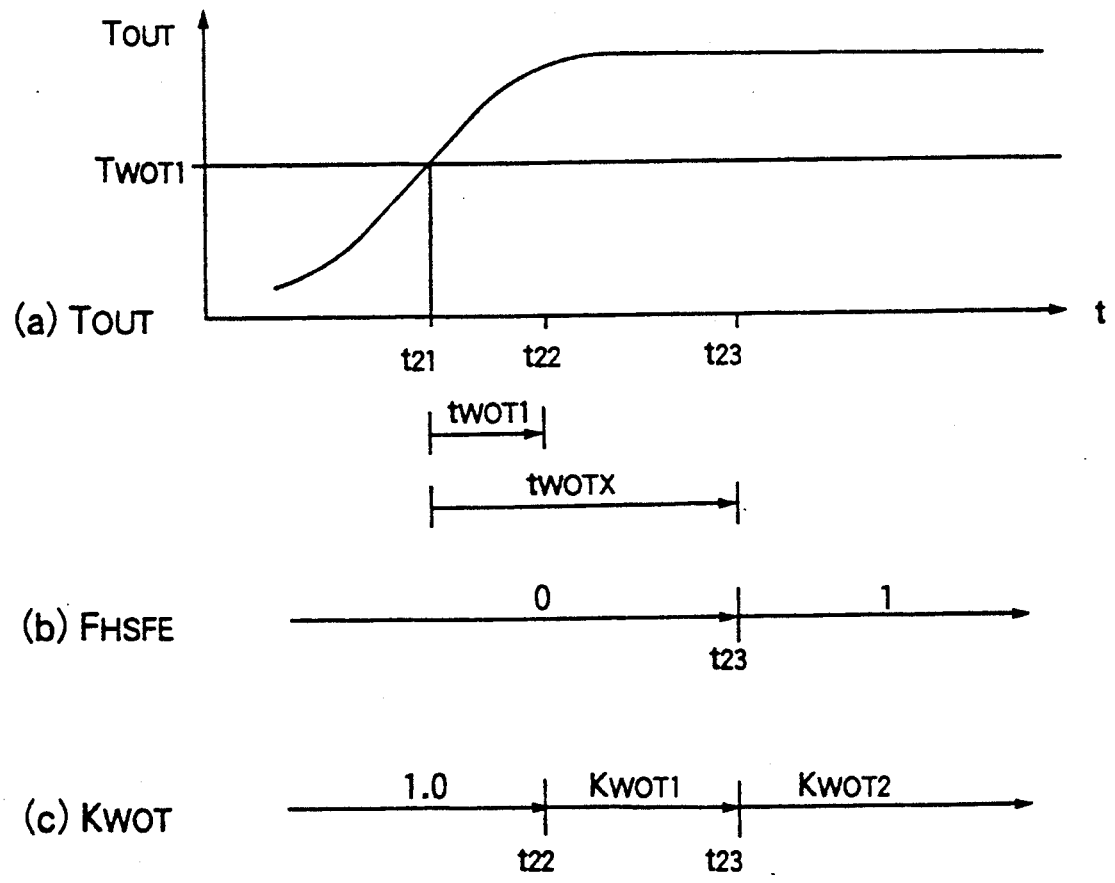
FIGS. 11, *a–c* are a diagram showing an example of setting of the high load-dependent incremental coefficient ($K_{WOT}$) in Region I*b* in FIG. 11.

(3) In Region Ib in FIG. 10, as shown in FIG. 11, i) from the time point $t_{21}$ the engine operating condition entered Region Ib to the time point $t_{22}$ the predetermined time period $t_{WOT1}$ has elapsed thereafter, $K_{WOT}=1.0$, ii from the time point $t_{22}$ to the time point $t_{23}$ the first flag $F_{HSFE}$ is changed from 0 to 1 (when the integrated time period $t_{WOTX}$ has elapsed after the time point $t_{21}$), $K_{WOT}=K_{WOT1}=K_{WOTO}=X_{WOTL}=X_{WOT}$, and iii) after the time point $t_{23}$, $K_{WOT}=K_{WOT2}=K_{WOTO}=X_{WOT}$.

Figure 12:
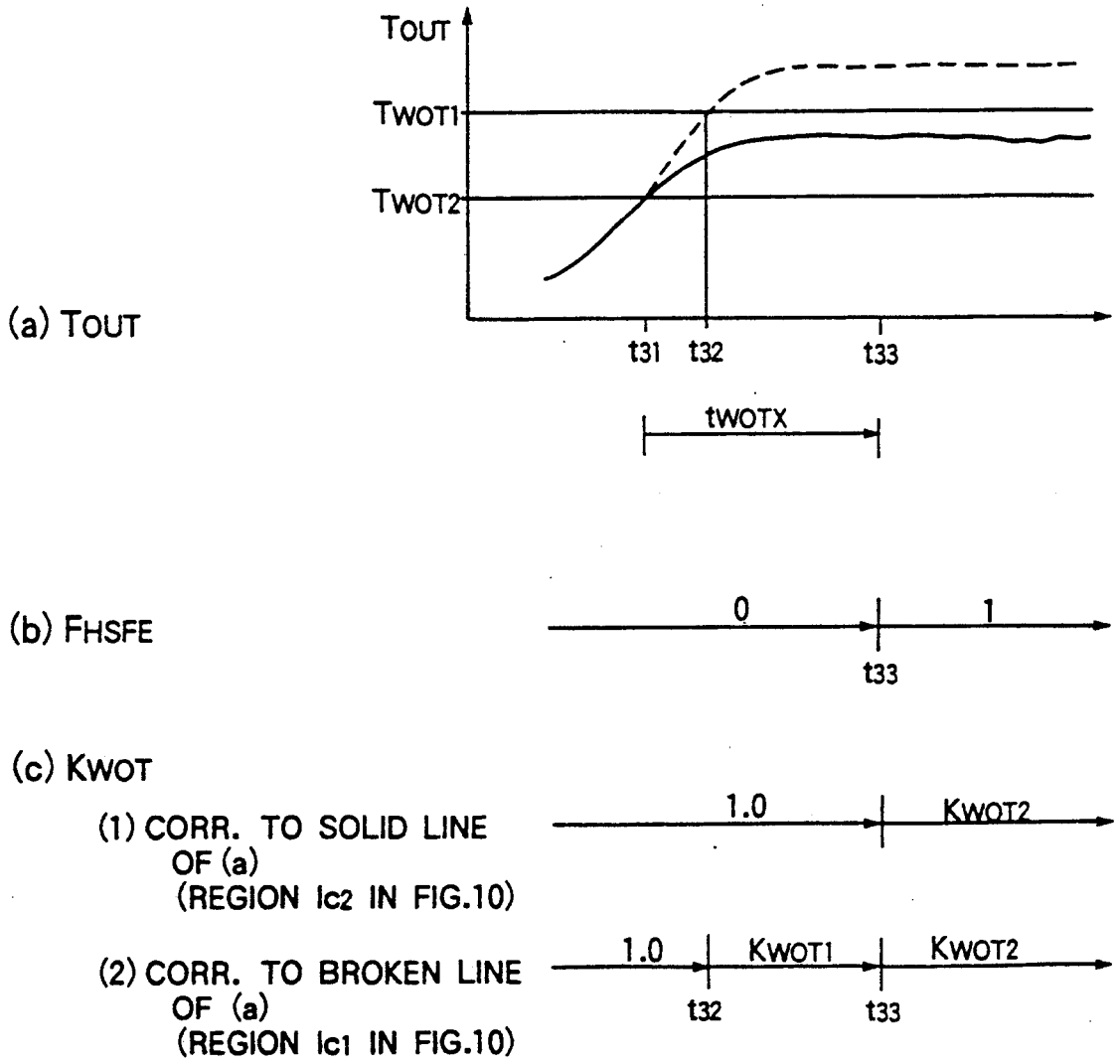
FIGS. 12, *a–c* are a diagram showing an example of setting of the high load-dependent incremental coefficient ($K_{WOT}$) in Regions $Ic_1$ and $Ic_2$ in FIG. 10.

(4) In Region $Ic_2$ in FIG. 10, as shown by the solid line of (a) in FIG. 12, and at (b) and (1) of (c) in same, i) up to the time point $t_{33}$ the first flag $F_{HSFE}$ is changed from 0 to 1 (when the integrated time period $t_{WOTX}$ has passed from the time point $t_{31}$ the engine operating condition entered Region $Ic_2$), $K_{WOT}=1.0$, and ii) after the time point $t_{33}$, $K_{WOT}=K_{WOT2}$.

(5) In Region $Ic_1$ in FIG. 10, as shown by the broken line of (a) in FIG. 12, and at (b) and (2) of (c) in same, i) from the time point $t_{32}$ the engine operating condition entered Region $Ic_1$ to the time point $t_{33}$ the first flag $F_{HSFE}$ is changed from 0 to 1, $K_{WOT}=K_{WOT1}$, and ii) after the time point $t_{33}$, $K_{WOT}=K_{WOT2}$.

When the mixture is not enriched depending 0n the engine temperature $X_{WOT}=1.0$), the values of $K_{WOT1}$ and $K_{WOT2}$ are set to such values as to make the air-fuel ratio equal to 13.5 and 12.5, respectively.

Further, when $K_{WOT}=1.0$, i.e. when the engine operating condition is in one of Regions IIa, IIb, and IIc in FIG. 10, or when it is in Region $Ic_2$ in same and at the same time the first flag $F_{HSFE}=0$, the feedback control of the air-fuel ratio is carried out by the air-fuel ratio feedback control correction coefficient $K_{O2}$ responsive to the concentration of oxygen in the exhaust gases, whereby excellent exhaust emission characteristics is preserved. In the other cases, i.e. when the engine operating condition is in Region $Ic_1$ in FIG. 10, or when it is in Region $Ic_2$ and at the same time the first flag $F_{HSFE}=1$, the air-fuel ratio feedback control correction coefficient $K_{O2}$ is set to 1.0 (non-correction value), and therefore the feedback control responsive to the concentration of oxygen in the exhaust gases is not carried out.

Figure 13:
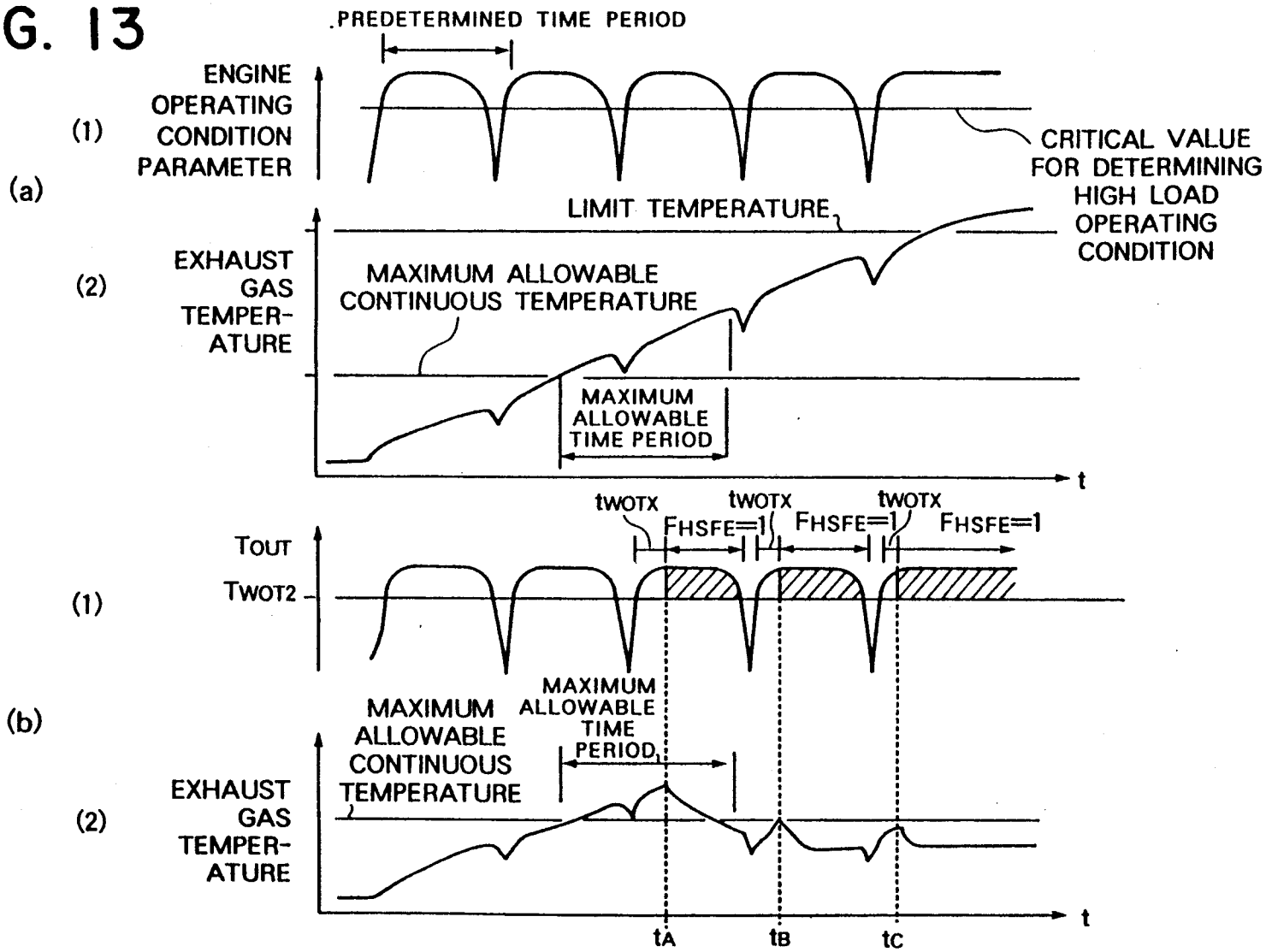
FIGS. 13, *a* and *b* are a diagram showing variations in the temperature of exhaust gases when the engine intermittently operates under high load operating conditions.

By setting the high load-dependent incremental coefficient $K_{WOT}$ as described above, even when operation of the engine under a high load condition lasting for a relatively short time period is repeatedly carried out, the above-mentioned integrated time period $t_{WOTX}$ depends on the ratio of the length of the integrated time period over which the engine operating condition was in the WOT region ($T_{OUT}>T_{WOT2}$) before the calculation of the integrated time period $t_{WOTX}$ to the length Of the integrated time period over which the feedback control was carried out before the calculation of the time period $t_{WOTX}$ (see FIG. 8), i.e. the longer the time period over which the engine operating condition was in the WOT region as compared with the time period over which the engine operating condition was outside the WOT region before the calculation of the time period $t_{WOTX}$, the shorter the integrated time period $t_{WOTX}$. This makes it possible to properly enrich the air-fuel ratio to thereby cool the engine by fuel. As a result, even if the temperature of the exhaust gases may exceed the maximum allowable continuous temperature, it decreases below the maximum allowable continuous temperature within the maximum allowable time period during which the engine can withstand temperatures between the maximum allowable continuous temperature and the limit temperature, and thereafter, the temperature continues to be below the maximum allowable continuous temperature ((2) of (b) in FIG. 13), so that an excessive rise in the temperature of the catalyst of the exhaust gas-purifying device can be prevented to thereby prolong the life of the catalyst.

Further, the longer the time period over which the engine operating condition was in the feedback control region, the longer the integrated time period $t_{WOTX}$ (the maximum value is limited to the reference time period $T_{BASE}$, e.g. 30 seconds). Therefore, the length of time during which the air-fuel ratio is enriched for cooling-by-fuel can be decreased while preventing an excessive rise in the temperature of the exhaust gases, to thereby decrease the amount of emission of HC and CO, and improve fuel consumption.

Further, the results of statistical research of durations of high load operation of the engine when the vehicle is normally driven by users, approximately 80% of the durations are within 30 seconds. Therefore, by setting the maximum value of the integrated time period $t_{WOTX}$ to 30 seconds, in most cases of the high load operation of the engine, enriching of the air-fuel ratio for the purpose of cooling-by-fuel is not carried out, which makes it possible to reduce the amounts of CO and HC in the exhaust gases.

Figure 14:
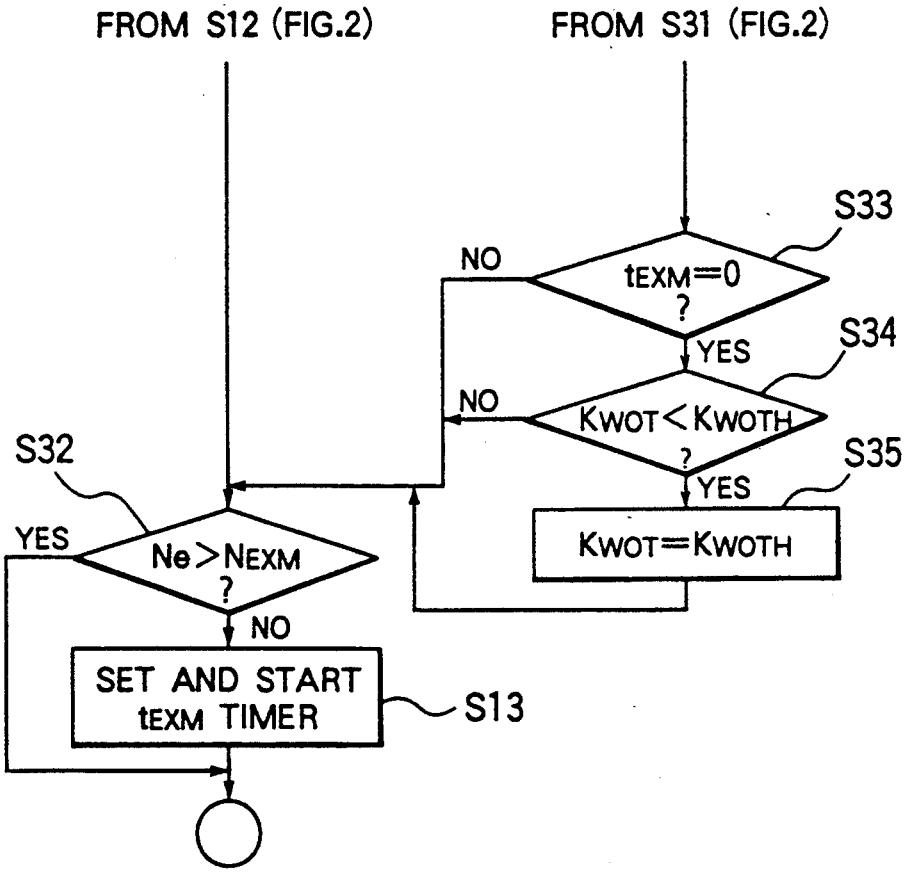
FIG. 14 is a flowchart showing part of a subroutine for setting the high load-dependent incremental coefficient ($K_{WOT}$) according to a second embodiment of the invention.

FIG. 14 shows part of a subroutine for calculating the high load-dependent incremental coefficient $K_{WOT}$ according to a second embodiment of the invention. In this embodiment, the steps S13 and S32 to S35 of the subroutine of FIG. 2 for setting the high load-dependent incremental coefficient $K_{WOT}$ are changed as shown in FIG. 4. More specifically, the program of FIG. 14 is different from that of FIG. 2 in the order of execution of the steps S13, and S32 to S35, with the operation of respective corresponding steps being the same.

According to the FIG. 14 program, when the program proceeds to the step S32 via the steps S11 and S12, i.e. when the fuel supply is not increased by the high load-dependent incremental coefficient $K_{WOT}$, it is determined at the step S32 whether or not the engine rotational speed Ne is higher than the second predetermined value $N_{EXM}$. If the answer to this question is negative (No), i.e. if $Ne \leqq N_{EXM}$, the $t_{EXM}$ timer is set to the predetermined time period $t_{EXM}$ and started at the step S13, followed by terminating the present program, whereas if the answer is affirmative (Yes), i.e. if $Ne > N_{EXM}$, the program is immediately terminated.

On the other hand, when the program proceeds to the step S33 from the step S31, i.e. when the fuel supply is increased by the high load-dependent incremental coefficient $K_{WOT}$, it is determined at the step S33 whether or not the down-counted value of the $t_{EXM}$ timer started at the step S13 is equal to 0. If the answer to this question is negative (No), i.e. if $t_{EXM} > 0$, the program immediately proceeds to the step S32, whereas if the answer is affirmative (Yes), i.e. $t_{EXM} = 0$, the high load-dependent incremental coefficient $K_{WOT}$ is set to a value equal to or higher than the predetermined enriching value $K_{WOTH}$ by the steps S34 and S35, and then the program proceeds to the step S32.

According to this embodiment, the predetermined time period $t_{EXM}$ starts to be counted down when the condition of $Ne > N_{EXM}$ is satisfied irrespective of whether or not the engine operating condition is in the WOT region, so that the air-fuel ratio is enriched to restrain a rise in the temperature of exhaust gases occurring during the air-fuel ratio feedback control in the relatively high load region of the engine operating condition. Consequently, an excessive rise in the temperature of the three-way catalyst 14 can be more effectively prevented.

Figure 15A:
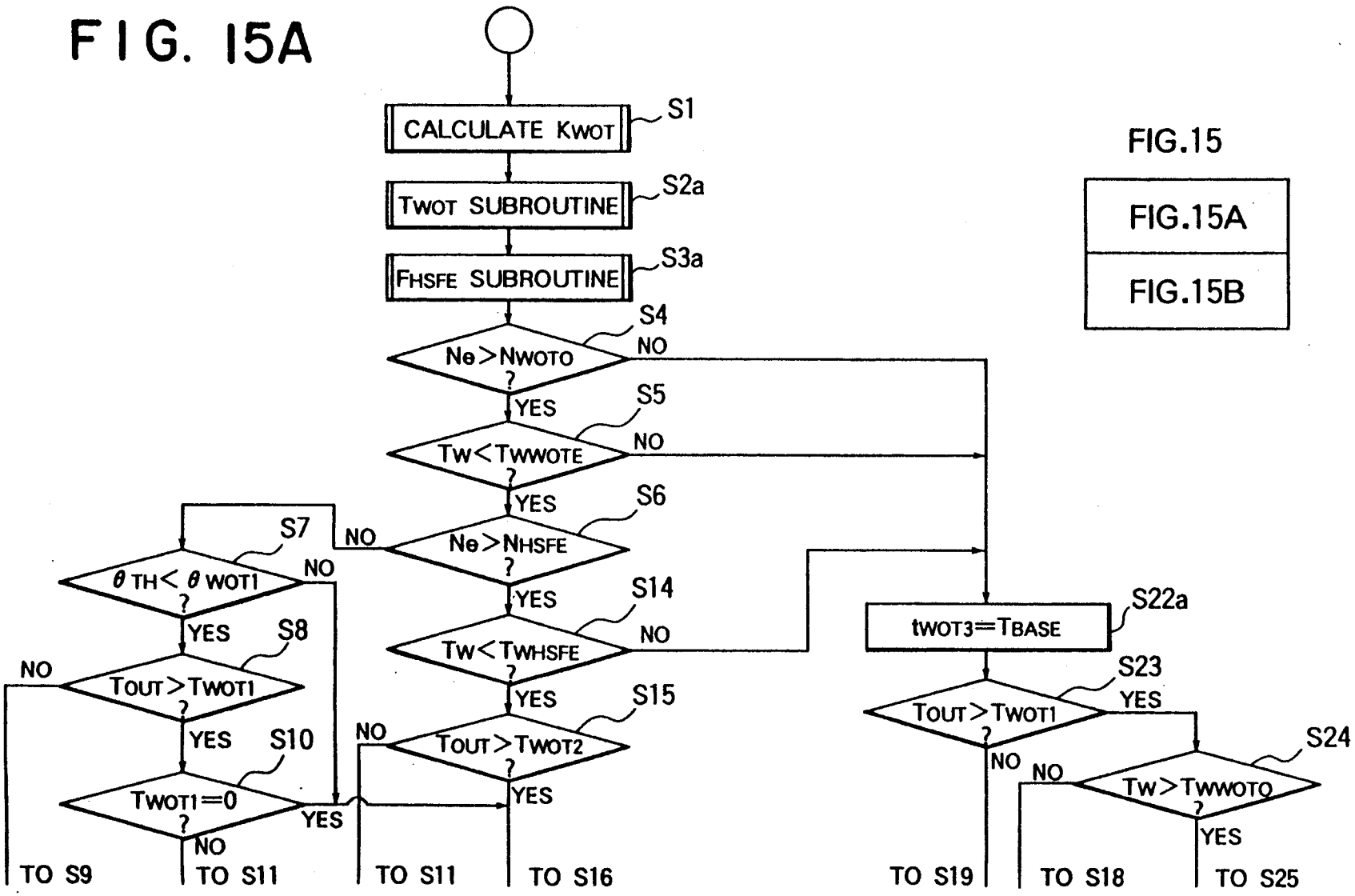
FIG. 15 is a flowchart showing a subroutine for setting the high load-dependent incremental coefficient ($K_{WOT}$) according to a third embodiment of the invention.
Figure 15B:
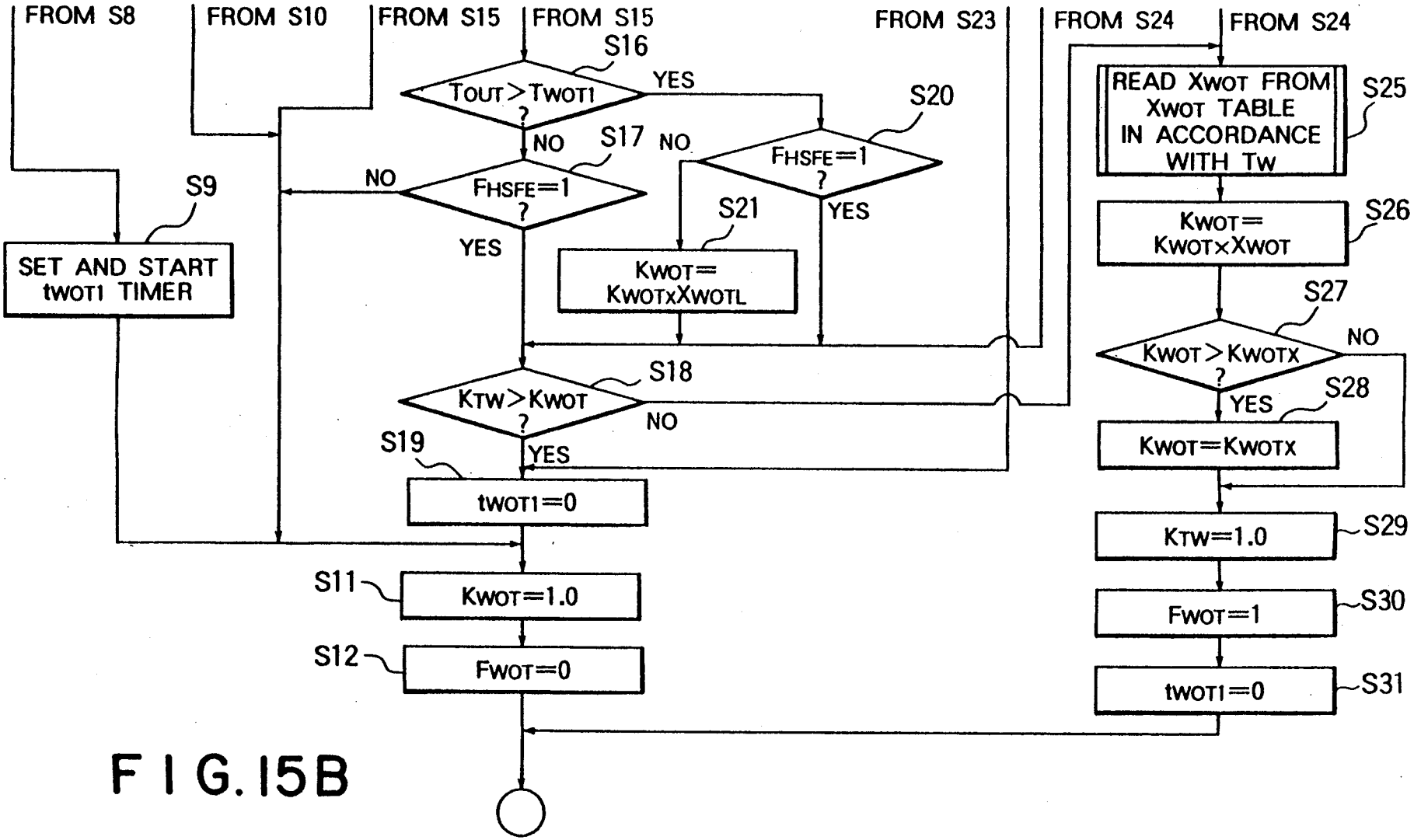

FIG. 15 shows a subroutine for setting the high load-dependent incremental coefficient $K_{WOT}$ according to a third embodiment of the invention. The identical steps corresponding to those of FIG. 2 are designated by the same step numbers. Only the points of the program of FIG. 15 different from that of FIG. 2 will be described below.

Figure 16:
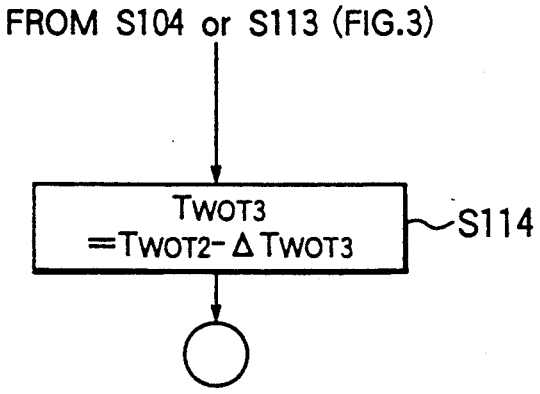
FIG. 16 is a flowchart showing part of a subroutine for setting the reference value ($T_{WOT}$) used in the subroutine of FIG. 15.

First, setting of the reference value $T_{WOT}$ at a step S2a is executed by a subroutine shown in FIG. 16. The subroutine of FIG. 16 is different from that of FIG. 3 in that a step S114 is added after the step S104 or S113. At the step S114, a third reference value $T_{WOT3}$ is obtained by subtracting a predetermined value $\Delta T_{WOT3}$ from the second reference value $T_{WOT2}$. Thus, the third reference value $T_{WOT3}$ is set as indicated by the one dot chain line in FIG. 6.

Figure 17:
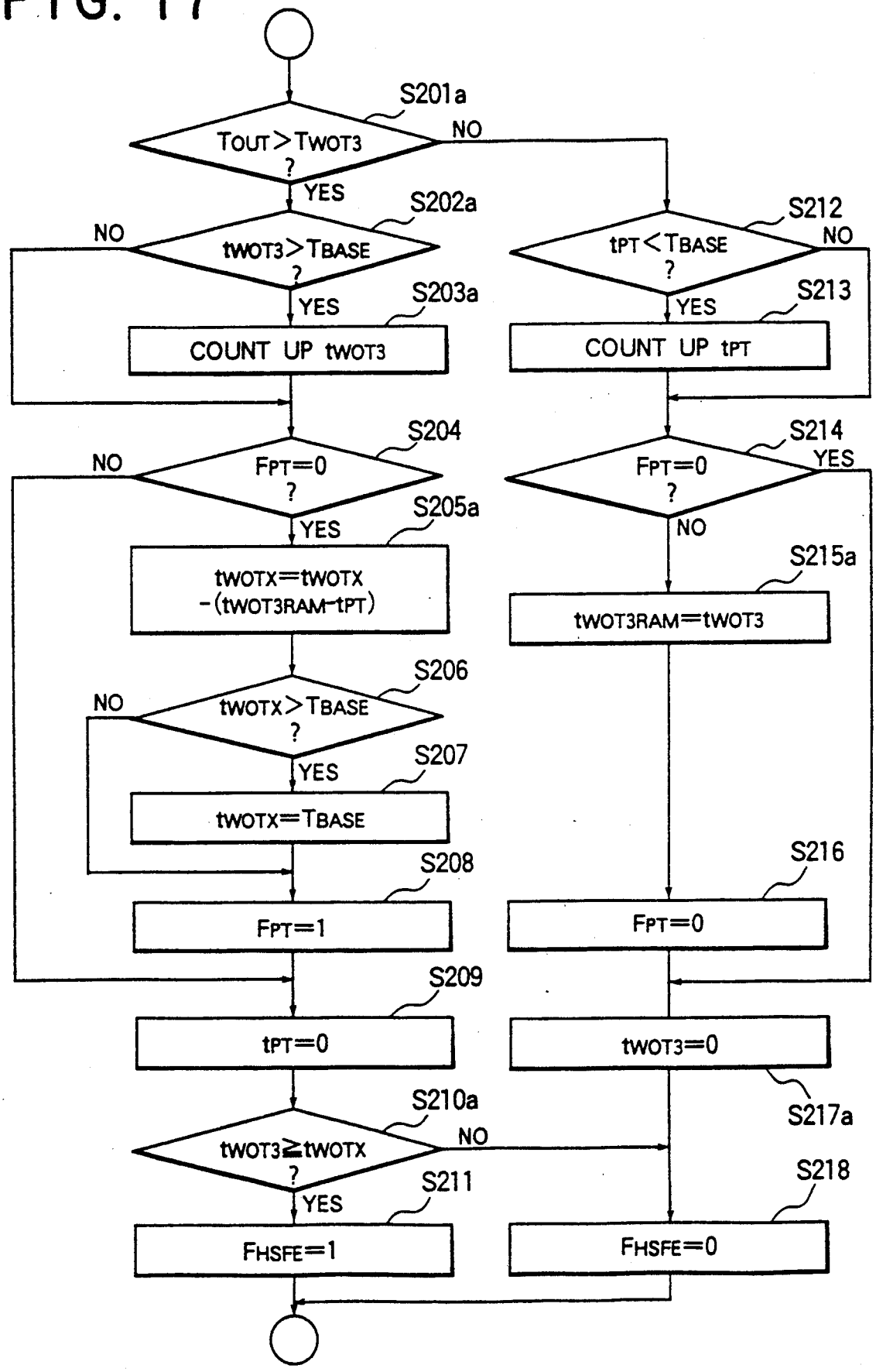
FIG. 17 is a flowchart showing of a subroutine for setting the flat ($F_{HSFE}$) used in the subroutine of FIG. 15.

Next, setting of the first flag $F_{HSFE}$ at a step S3a is executed by a subroutine shown in FIG. 17. The program of FIG. 17 is different from that of FIG. 4 in that $T_{WOT2}$, $t_{WOT2RAM}$, and $t_{WOT2}$ are replaced by $T_{WOT3}$, $t_{WOT3RAM}$, and $t_{WOT3}$, respectively, i.e. the former is different from the latter in the steps S201a, S202a, S203a, S205a, S210a, S215a, and 217a, and the other corresponding steps are identical.

Figure 18:
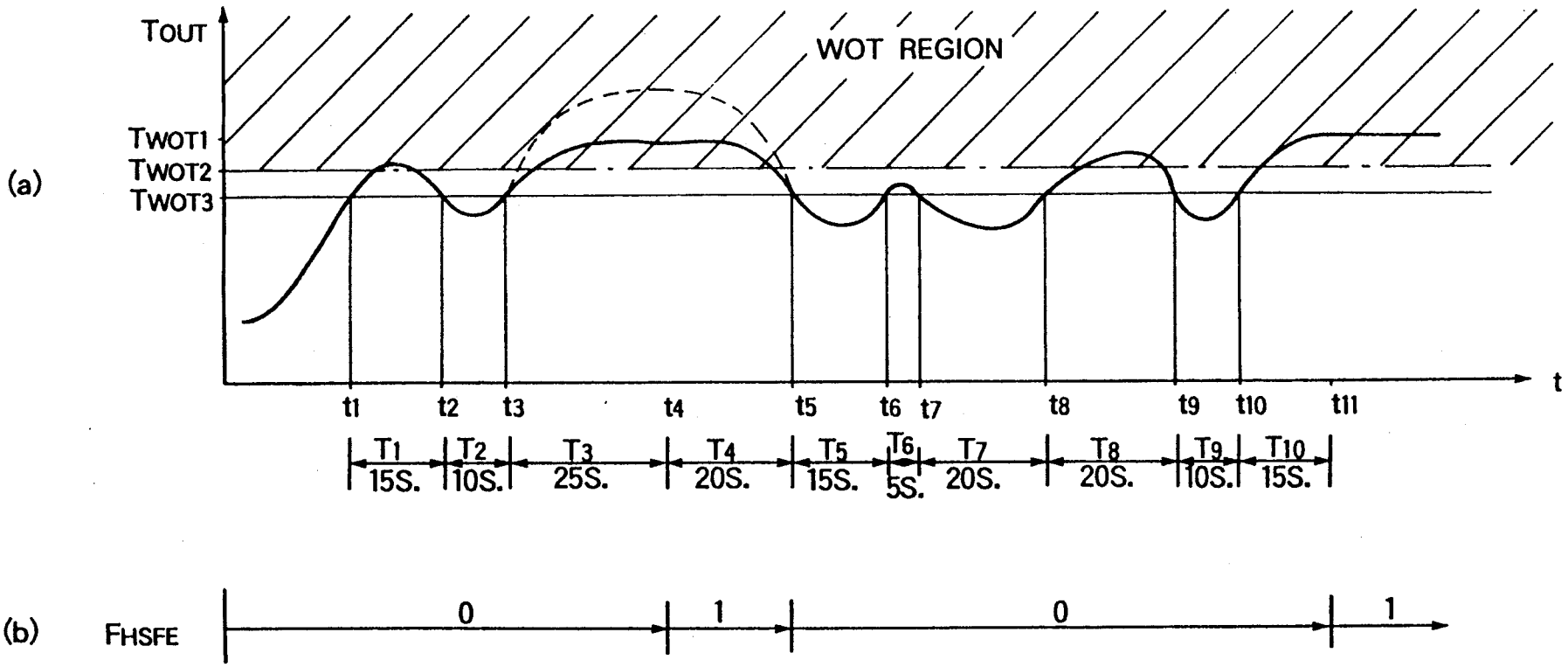
FIGS. 18, *a* and *b* are a diagram useful in explaining the operation of the subroutine of FIG. 17.

According to the program of FIG. 17, the first flag $F_{HSFE}$ is set in accordance with the integrated time period $t_{WOTX}$ calculated depending on whether the fuel injection period is longer than the third reference value $T_{WOT3}$, but not depending on whether the engine operating condition is in the W0T region, as shown in FIG. 18 (in which there is shown an example of setting the first flag $F_{HSFE}$ under the same engine operating conditions as FIG. 8, with $T_{BASE}$ being equal to 30 seconds). More specifically, when the condition of $T_{OUT} \leqq T_{WOT3}$ is satisfied, or from a time point the condition of $T_{OUT} > T_{WOT3}$ starts to be satisfied to a time point the integrated time period $t_{WOTX}$ calculated at the first-mentioned time point has elapsed from same (i.e. during time up to the time point $t_4$ or from the time point $t_5$ to the time point $t_{11}$), the first flag $F_{HSFE}$ is set to 0, whereas when the condition of $T_{OUT} > T_{WOT3}$ is satisfied after the $t_{WOTX}$ has elapsed (i.e. from the time point $t_4$ to the time point $t_5$, and after the time point $t_{11}$), the first flag $F_{HSFE}$ is set to 1.

Referring again to FIG. 15, at a step S22a, a $t_{WOT3}$ timer is set to the reference time period $T_{BASE}$ in correspondence to the program of FIG. 17. Further, after execution of the step S12 or S31, the program is terminated without executing the step S13 or the steps S32 to S35 in FIG. 2.

According to the program of FIG. 15, the high load-dependent incremental coefficient $K_{WOT}$ is set in the following manner, except when the engine coolant temperature $T_W$ is very high (either of the answers to the questions of the steps S5 and S14 is negative (No), i.e. $T_W \geqq T_{WWOTE}$ or $T_W \geqq T_{WHSFE}$).

Figure 19:
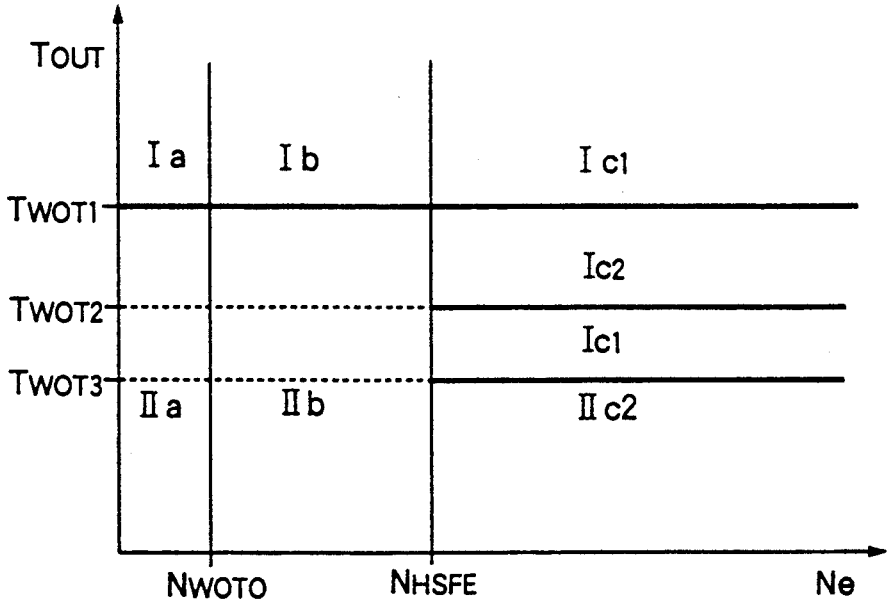
FIG. 19 is a diagram showing engine operating regions defined by the engine rotational speed (Ne) and the fuel injection time period ($T_{OUT}$)

(1) In Regions IIa, IIb, IIc, and $IIc_2$ in FIG. 19 (outside the WOT region), $K_{WOT} = 1.0$ (non-correction value).

(2) In Region Ia in FIG. 19, $K_{WOT} = K_{WOTO} = X_{WOT}$ ($K_{WOTO}$ is a value of the $K_{WOT}$ calculated at the step S1.)

(3) In Region Ib in FIG. 19, as shown in FIG. 20, i) from the time point $t_{21}$ the engine operating condition entered Region Ib to the time point $t_{22}$ the predetermined time period $t_{WOT1}$ has elapsed thereafter, $K_{WOT} = 1.0$, ii) from the time point $t_{22}$ to the time point $t_{23}$ the first flag $F_{HSFE}$ is changed from 0 to 1 (when the integrated time period $t_{WOTX}$ has elapsed after the time point $t_{20}$ when the $T_{OUT}$ becomes equal to $T_{WOT3}$), $K_{WOT} = K_{WOT1} = K_{WOTO} = X_{WOTL} = X_{WOT}$, and iii) after the time point $t_{23}$, $K_{WOT} = K_{WOT2} = K_{WOTO} = X_{WOT}$.

(4) In Region $Ic_2$ in FIG. 19, as shown by the solid line of (a) in FIG. 21, and at (b) and (1) of (c) in same, (i) up to the time point $t_{33}$ the first flag $F_{HSFE}$ is changed from 0 to 1 (when the integrated time period $t_{WOTX}$ has elapsed from the time point $t_{30}$ the $T_{OUT}$ becomes equal to $T_{WOT3}$), $K_{WOT} = 1.0$, and ii) after the time point $t_{33}$, $K_{WOT} = K_{WOT2}$.

(5) In Region $Ic_1$ in FIG. 19, as shown by the broken line of (a) in FIG. 21, and at (b) and (2) of (c) in same, (i) from the time point $t_{32}$ the engine operating condition entered Region $Ic_1$ to the time point $t_{33}$ the first flag $F_{HSFE}$ is changed from 0 to 1, $K_{WOT} = K_{WOT1}$, and ii) after the time point $t_{33}$, $K_{WOT} = K_{WOT2}$.

When the mixture is not enriched depending on the engine temperature($X_{WOT} = 1.0$), the values $K_{WOT1}$ and $K_{WOT2}$ are set to such values as to make the air-fuel ratio equal to 13.5 and 12.5, respectively.

Further, when $K_{WOT}=1.0$, when the engine operating condition is in one of Regions IIa, IIb, $IIc_1$, and $IIc_2$ in FIG. 19, or when it is in Region $Ic_2$ in same and at the same time the first flag $F_{HSFE}=0$, the feedback control of the air-fuel ratio is carried out by the use of the air-fuel ratio feedback control correction coefficient $K_{02}$ responsive to the concentration of oxygen in the exhaust gases, whereby excellent exhaust emission characteristics is preserved. In the other cases, i.e. when the engine operating condition is in Region $Ic_1$ in FIG. 19, or when it is in Region $Ic_2$ and at the same time the first fla $F_{HSFE}=1$, the air-fuel ratio feedback control correction coefficient K is set to 1.0 (non-correction value), and therefore the feedback control responsive to the concentration of oxygen in the exhaust gases is not carried out.

By setting the high load-dependent incremental coefficient $K_{WOT}$ as described above, even when operation of the engine under a high load condition lasting for a relatively short time period is repeatedly carried out, enriching of the air-fuel ratio for the purpose of cooling-by-fuel can be properly carried out, since the integrated time period $t_{WOTX}$ which determines time for enriching the air-fuel ratio, i.e. time for changing the first flag $F_{HSFE}$ from 0 to 1 depends on the ratio of the length of the integrated time period over which the condition of $T_{OUT}>T_{WOT3}$ was satisfied to the length of the integrated time period over which the condition of $T_{OUT}\leqq T_{WOT3}$ was satisfied before calculation of the $t_{WOTX}$ (see FIG. 18), i.e. the longer the time period during which the condition of $T_{OUT}>T_{WOT3}$ was satisfied compared with the time period over which the condition of $T_{OUT}\leqq T_{WOT3}$ was satisfied before calculation of the time period $t_{WOTX}$, the shorter the integrated time period $t_{WOTX}$. This makes it possible to properly enrich the air-fuel ratio to thereby cool the engine by fuel. Moreover, the third reference value $T_{WOT3}$ is set at a value smaller than the second reference value $T_{WOT2}$. Therefore, if the engine operating condition in which the fuel injection time period $T_{OUT}$ repeatedly goes up and down in the vicinity of the third reference value $T_{WOT3}$, i.e. the engine operating condition in the air-fuel ratio feedback control region on the higher load side (e.g. the engine operating condition in Region $IIc_1$ in FIG. 19) is continued and then shifts to the WOT region ($T_{OUT}>T_{WOT2}$), the air-fuel ratio starts to be enriched in a relatively short time period (at the time point $t_{11}$ in FIG. 18). Thus, the enriching of the air-fuel ratio for the purpose of cooling-by-fuel is carried out while taking into consideration a rise in the temperature of the exhaust gases caused by the operation of the engine in the air-fuel ratio feedback control region on the higher load side (partial load operation). As a result, an excessive rise in the temperature of the three-way catalyst 14 can be more accurately prevented to thereby prolong the life thereof.

What is claimed is:

1. In a method of controlling the air-fuel ratio of an air-fuel mixture supplied to an internal combustion engine having an exhaust system having an exhaust gas ingredient concentration sensor arranged therein, including the steps of:

detecting load on said engine;

detecting a value of the concentration of an exhaust gas ingredient by said exhaust gas ingredient concentration sensor;

carrying out feedback control of the air-fuel ratio of said air-fuel mixture to a predetermined value in response to the value of the concentration of said exhaust gas ingredient detected by said exhaust gas ingredient concentration sensor; and interrupting the feedback control of the air-fuel ratio of said air-fuel mixture and enriching the air-fuel ratio of said air-fuel mixture after a high load operating condition of said engine in which the detected load on said engine is above a predetermined reference value has continued over a predetermined time period;

the improvement comprising the steps of:

(1) calculating a value of a parameter dependent on a ratio of a time period over which the detected load on said engine continued to be above a predetermined value to a time period over which the detected load on said engine continued to be below said predetermined value; and (2) setting said predetermined time period based on the calculated value of said parameter dependent on said ratio.

2. A method according to claim 1, wherein said predetermined time period is calculated whenever the detected load on said engine exceeds said predetermined value, by the following equation:

$$t_{WOTX(n)}-t_{WOTX(n-1)}+(t_{FB}-t_{WOT})$$

Where $t_{WOTX(n)}$ represents a present value of said predetermined time period;

$t_{WOTX}(n-1)$ represent an immediately preceding value of said predetermined time period $t_{FB}$ represents a time period, over which the detected load on said engine continued to be below said predetermined value, between a time point of calculation of said immediately preceding value of said predetermined time period and a time point of calculation of said present value of said predetermined time period; and $t_{WOT}$ represents a time period, over which the detected load on said engine continued to be above said predetermined value, between the time point of calculation of said immediately preceding value of said predetermined time period and the time point of calculation of said present value of said predetermined time period.

3. A method according to claim 1 or 2, wherein said predetermined value is equal to said predetermined reference value.

4. A method according to claim 3, including the step of detecting the rotational speed of said engine, and wherein the air-fuel ratio of said air-fuel mixture is enriched to a degree higher than a predetermine d level when the detected rotational speed of said engine is higher than a predetermined value, and at the same time the detected load on said engine has continued to be above said predetermined value for a predetermined time period.

5. A method according to claim 1 or 2, wherein said predetermined value is smaller than said predetermined reference value

6. In a method of controlling the air-fuel ratio of an air-fuel mixture supplied to an internal combustion engine having an exhaust system having an exhaust gas ingredient concentration sensor arranged therein, including the steps of:

detecting load on said engine;

detecting a value of the concentration of an exhaust gas ingredient by said exhaust gas ingredient concentration sensor;

carrying out feedback control of the air-fuel ratio of said air-fuel mixture to a predetermined value in response to the value of the concentration said exhaust gas ingredient detected by said exhaust gas ingredient concentration sensor; and interrupting the feedback control of the air-fuel ratio of said air-fuel mixture and enriching the air-fuel ratio of said air-fuel mixture after a high load operating condition of said engine in which the detected load on said engine is above a predetermined reference value has continued over a predetermined time period;

the improvement comprising the Step of starting counting said predetermined time period when the detected load on said engine exceeds a predetermined value lower than said predetermined reference value during the feedback control of the air-fuel ratio.

7. In a method of controlling the air-fuel ratio of an air-fuel mixture supplied to an internal combustion engine having an exhaust system having an exhaust gas ingredient concentration sensor arranged therein, including the steps of:

detecting load on said engine;

detecting a value of the concentration of an exhaust gas ingredient by said exhaust gas ingredient concentration sensor;

carrying out feedback control of the air-fuel ratio of said air-fuel mixture to a predetermined value in response to the value of the concentration of said exhaust gas ingredient detected by said exhaust gas ingredient concentration sensor; and interrupting the feedback control of the air-fuel ratio of said air-fuel mixture and enriching the air-fuel ratio of said air-fuel mixture after a high load operating condition of said engine in which the detected load on said engine is above a predetermined reference value has continued over a predetermined time period;

the improvement comprising the steps of:

(1) detecting the rotational speed of said engine; and (2) starting counting said predetermined time period when the detected rotational speed of said engine exceeds a predetermined value during the feedback control of the air-fuel ratio.

8. A method according to any of claims 1, 2, 6, or 7, wherein the air-fuel ratio of said air-fuel mixture is enriched immediately when the detected load on said engine exceeds a predetermined high load value higher than said predetermined reference value, and is further enriched after said predetermined time period elapses.

9. A method according to any of claims 1, 2, 6, or 7, including the steps of detecting the rotational speed of said engine, a temperature of said engine, and atmospheric pressure, and wherein said predetermined reference value is set to a value depending on the detected rotational speed of said engine, the detected temperature of said engine, and the detected atmospheric temperature.

10. A method according to any of claims 1, 2, or 6, including the step of detecting a temperature of said engine, and wherein the air-fuel ratio of said air-fuel mixture is enriched to a degree depending on the detected temperature of said engine.

11. A method according to any of claims 1, 2, 6, or 7, including the steps of:

detecting a temperature of said engine;

calculating a temperature-dependent incremental coefficient for increasing an amount of fuel supplied to said engine, based on the detected temperature of said engine;

calculating a high load-dependent incremental coefficient for increasing said amount of fuel supplied to said engine to effect enriching of the air-fuel ratio under said high load operating condition; and inhibiting enriching of the air-fuel ratio by said high load-dependent incremental coefficient when said temperature-dependent incremental coefficient is larger than said high load-dependent incremental coefficient.

12. A method according to any of claims 1, 2, 6, or 7, wherein said load on said engine is detected by an amount of fuel supplied to said engine.

* * * * *